US011826810B2

(12) United States Patent
Kohno et al.

(10) Patent No.: US 11,826,810 B2
(45) Date of Patent: Nov. 28, 2023

(54) DIE CUSHION DEVICE AND METHOD FOR CONTROLLING DIE CUSHION DEVICE

(71) Applicant: AIDA ENGINEERING, LTD., Kanagawa (JP)

(72) Inventors: Yasuyuki Kohno, Kanagawa (JP); Kazufumi Tsuchida, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 471 days.

(21) Appl. No.: 17/076,497

(22) Filed: Oct. 21, 2020

(65) Prior Publication Data

US 2021/0121932 A1 Apr. 29, 2021

(30) Foreign Application Priority Data

Oct. 23, 2019 (JP) ..... 2019-192547

(51) Int. Cl.
*B21D 24/02* (2006.01)

(52) U.S. Cl.
CPC ..... *B21D 24/02* (2013.01)

(58) Field of Classification Search
CPC ..... B21D 24/02; B21D 24/10; B21D 24/14; B30B 15/061
USPC ..... 72/351, 453.13
See application file for complete search history.

(56) References Cited

U.S. PATENT DOCUMENTS

2014/0202223 A1* 7/2014 Kohno ..... B30B 15/24 72/20.1
2016/0354828 A1 12/2016 Kohno

FOREIGN PATENT DOCUMENTS

JP 04-371326 A 12/1992
JP 2014-140871 A 8/2014
JP 2016-221564 A 12/2016

OTHER PUBLICATIONS

German Official Communication issued in corresponding German Patent Application No. 18292815815.2 dated Jun. 21, 2021, with Engiish translation.
Japanese Office Action dated Jul. 22, 2022 in a counterpart Japanese Patent Application No. 2019-192547, with English translation.

* cited by examiner

*Primary Examiner* — Jimmy T Nguyen
*Assistant Examiner* — Smith Oberto Bapthelus
(74) *Attorney, Agent, or Firm* — McDermott Will & Emery LLP

(57) ABSTRACT

A die cushion device includes four hydraulic cylinders that support a cushion pad, a die cushion load controller that controls each of the hydraulic cylinders and generates a die cushion load on the cushion pad, and a die cushion position controller that controls each of the hydraulic cylinders to control a position of the cushion pad. In a case where only a left part is produced with a left die by a press machine, the die cushion load controller performs die cushion load control on two hydraulic cylinders on the left side, and the die cushion position controller performs die cushion position control on two hydraulic cylinders on the right side.

13 Claims, 16 Drawing Sheets

FIG.6
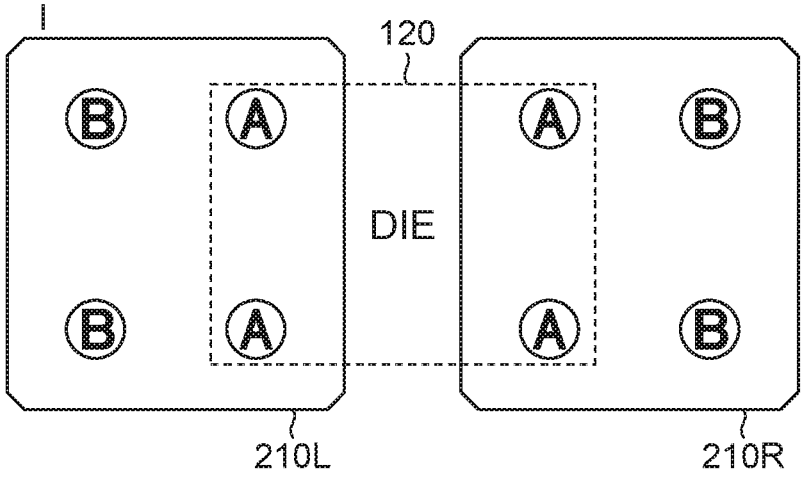
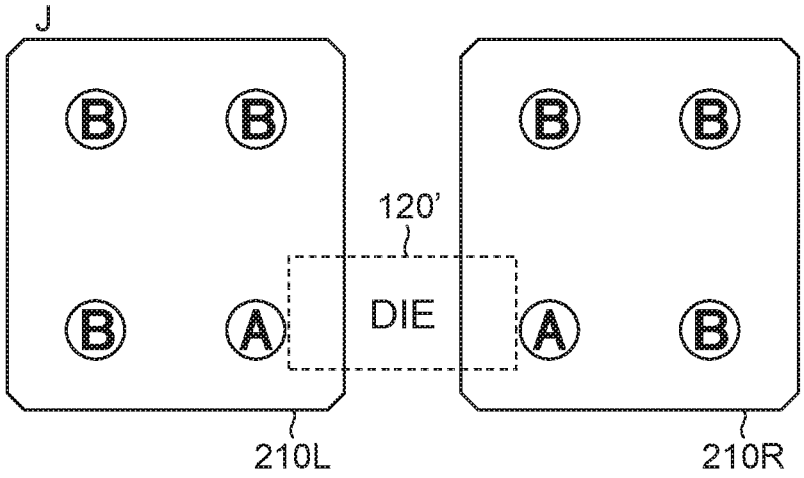

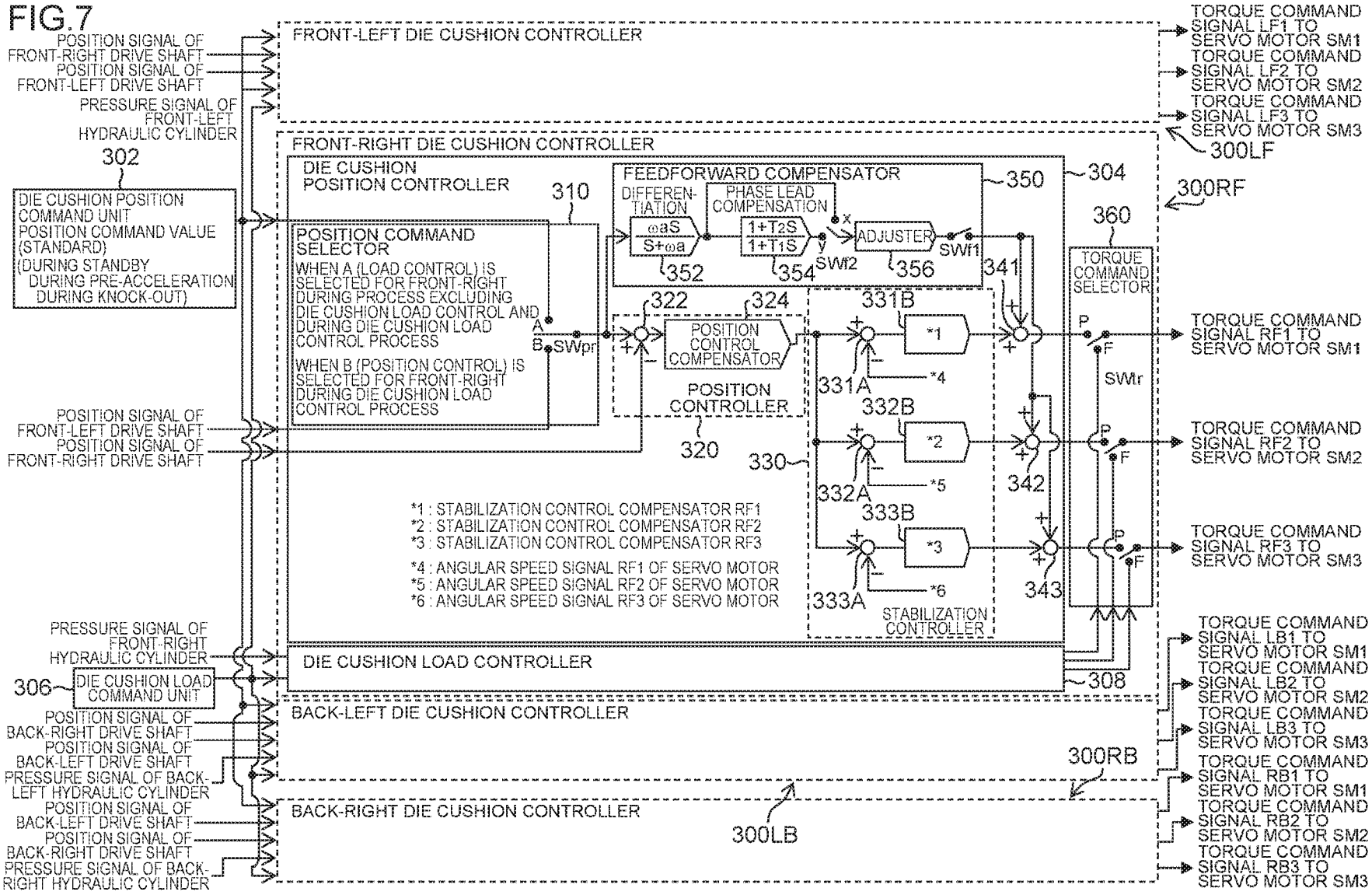
FIG.7
FRONT-LEFT DIE CUSHION CONTROLLER
FRONT-RIGHT DIE CUSHION CONTROLLER
BACK-LEFT DIE CUSHION CONTROLLER
BACK-RIGHT DIE CUSHION CONTROLLER
DIE CUSHION LOAD CONTROLLER
DIE CUSHION POSITION CONTROLLER
POSITION COMMAND SELECTOR
WHEN A (LOAD CONTROL) IS SELECTED FOR FRONT-RIGHT DURING PROCESS EXCLUDING DIE CUSHION LOAD CONTROL AND DURING DIE CUSHION LOAD CONTROL PROCESS
WHEN B (POSITION CONTROL) IS SELECTED FOR FRONT-RIGHT DURING DIE CUSHION LOAD CONTROL PROCESS
FEEDFORWARD COMPENSATOR
DIFFERENTIATION
PHASE LEAD COMPENSATION
ADJUSTER
POSITION CONTROL COMPENSATOR
POSITION CONTROLLER
STABILIZATION CONTROLLER
TORQUE COMMAND SELECTOR
*1 : STABILIZATION CONTROL COMPENSATOR RF1
*2 : STABILIZATION CONTROL COMPENSATOR RF2
*3 : STABILIZATION CONTROL COMPENSATOR RF3
*4 : ANGULAR SPEED SIGNAL RF1 OF SERVO MOTOR
*5 : ANGULAR SPEED SIGNAL RF2 OF SERVO MOTOR
*6 : ANGULAR SPEED SIGNAL RF3 OF SERVO MOTOR
TORQUE COMMAND SIGNAL LF1 TO SERVO MOTOR SM1
TORQUE COMMAND SIGNAL LF2 TO SERVO MOTOR SM2
TORQUE COMMAND SIGNAL LF3 TO SERVO MOTOR SM3
TORQUE COMMAND SIGNAL RF1 TO SERVO MOTOR SM1
TORQUE COMMAND SIGNAL RF2 TO SERVO MOTOR SM2
TORQUE COMMAND SIGNAL RF3 TO SERVO MOTOR SM3
TORQUE COMMAND SIGNAL LB1 TO SERVO MOTOR SM1
TORQUE COMMAND SIGNAL LB2 TO SERVO MOTOR SM2
TORQUE COMMAND SIGNAL LB3 TO SERVO MOTOR SM3
TORQUE COMMAND SIGNAL RB1 TO SERVO MOTOR SM1
TORQUE COMMAND SIGNAL RB2 TO SERVO MOTOR SM2
TORQUE COMMAND SIGNAL RB3 TO SERVO MOTOR SM3
POSITION SIGNAL OF FRONT-RIGHT DRIVE SHAFT
POSITION SIGNAL OF FRONT-LEFT DRIVE SHAFT
PRESSURE SIGNAL OF FRONT-LEFT HYDRAULIC CYLINDER
DIE CUSHION POSITION COMMAND UNIT
POSITION COMMAND VALUE (STANDARD)
(DURING STANDBY DURING PRE-ACCELERATION DURING KNOCK-OUT)
PRESSURE SIGNAL OF FRONT-RIGHT HYDRAULIC CYLINDER
DIE CUSHION LOAD COMMAND UNIT
POSITION SIGNAL OF BACK-RIGHT DRIVE SHAFT
POSITION SIGNAL OF BACK-LEFT DRIVE SHAFT
PRESSURE SIGNAL OF BACK-LEFT HYDRAULIC CYLINDER
PRESSURE SIGNAL OF BACK-RIGHT HYDRAULIC CYLINDER
300LF
300RF
300RB
300LB
302
304
306
308
310
320
322
324
330
331A
331B
332A
332B
333A
333B
341
342
343
350
352
354
356
360

DIE CUSHION DEVICE AND METHOD FOR CONTROLLING DIE CUSHION DEVICE

CROSS-REFERENCE TO RELATED APPLICATIONS

The present application claims priority under 35 U.S.C. § 119 to Japanese Patent Application No. 2019-192547, filed on Oct. 23, 2019. The above application is hereby expressly incorporated by reference, in its entirety, into the present application.

BACKGROUND OF THE INVENTION

Field of the Invention

The present invention relates to a die cushion device and a method for controlling the die cushion device, and particularly relates to a die cushion device and a method for controlling the die cushion device in which a die can be freely arranged.

Description of the Related Art

Japanese Patent Application Laid-Open No. 2016-221564 discloses a die cushion device in which a plurality of cushion pads are respectively supported by a plurality of drive shafts (hydraulic cylinders). In the die cushion device, a required die cushion load can act on each of the hydraulic cylinders and standby positions of the cushion pads can be changed (in order to change die cushion strokes).

FIG. 5 in Japanese Patent Application Laid-Open No. 2016-221564 shows a press machine to which a plurality of independent dies are attached, and a die cushion device having a plurality of cushion pads respectively corresponding to the plurality of dies.

By the way, as shown in FIG. 16, after producing two kinds of products with a press machine having a plurality of (two) dies 120L and 120R, there is a case where a user desires to remove one die 120R from the press machine so as to produce products using only the other die 120L.

For example, in a tandem line which performs volume production of bodies of automobiles, two kinds of products are produced at one cycle using two kinds of dies arranged left and right in parallel. After a number of two kinds of products are produced, there may be a case where defective pieces are found in the products produced on one side. In this case, a user may desire to continuously produce products on the one side in order to obtain products of the same number as the defective products.

When the die 120R is removed to produce products only with the die 120L as indicated by a broken line as shown in FIG. 16, the die 120L is arranged at a deviated position on (a projection surface of) a cushion pad 210 which is supported by four hydraulic cylinders at front-left, back-left, front-right and back-right (220LF, 220LB, 220RF and 220RB).

In this case, as indicated by an arrow in FIG. 16, because of die cushion load control over the four hydraulic cylinders (220LF, 220LB, 220RF and 220RB), the moment that rotates the cushion pad 210 in the direction indicated by the arrow in FIG. 16 acts on the cushion pad 210, and, as a result, the cushion pad 210 tilts (in FIG. 16, the right side of the cushion pad 210 is moved upward).

CITATION LIST

Patent Literature 1: Japanese Patent Application Laid-Open No. 2016-221564

SUMMARY OF THE INVENTION

As described above, in a case where a die is arranged at a deviated position on a cushion pad, there is a problem that the cushion pad tilts. Therefore, the arrangement of a die is limited.

As a result, for example, in a case where two dies are attached to a press machine for producing two kinds of products simultaneously, two kinds of products are produced even when only one kind of products is required to be produced to adjust the number of produced products for compensating a difference in number between the two types of products due to defective products after a predetermined number of products are produced. This causes the problem of wastes.

The present invention has been made in view of such a circumstance, and aims to provide a die cushion device and a method for controlling the die cushion device without limitation on arrangement of dies.

In order to achieve the object, a die cushion device according to one aspect of the present invention includes: a plurality of cushion pad raising and lowering devices which include a plurality of drive shafts configured to support a cushion pad, and are configured to drive the respective drive shafts to raise and lower the cushion pad; a die cushion load controller configured to control each of the drive shafts of the plurality of cushion pad raising and lowering devices to generate die cushion load on the cushion pad; a die cushion position controller configured to control each of the drive shafts of the plurality of cushion pad raising and lowering devices to control a position of the cushion pad; and a selector configured to independently select each of the drive shafts of the plurality of cushion pad raising and lowering devices, as either one of a first drive shaft subject to die cushion load control by the die cushion load controller and a second drive shaft not subject to the die cushion load control by the die cushion load controller, wherein, during a specific die cushion load control process, the die cushion load controller controls only the first drive shaft selected by the selector.

According to the one aspect of the present invention, each of the drive shafts of the plurality of cushion pad raising and lowering devices is independently selected as either one of the first drive shaft subject to the die cushion load control by the die cushion load controller and the second drive shaft not subject to the die cushion load control by the die cushion load controller. The selection of the first drive shaft or the second drive shaft in the drive shafts of the plurality of cushion pad raising and lowering devices is preferably determined in accordance with a region where a die is arranged on a projection plane of the cushion pad. For example, in a case where a die does not exist on a projection plane of a drive shaft, the drive shaft can be selected as the second drive shaft. During the specific die cushion load control process, the die cushion load controller controls only the first drive shaft and does not perform the die cushion load control on the second drive shaft. Thus, it is possible to prevent a die cushion load which tilts the cushion pad from the second drive shaft, thereby performing desirable die cushion load control on the cushion pad.

In the die cushion device according to another aspect of the present invention, the selector independently selects each of the drive shafts of the plurality of cushion pad raising and lowering devices, as either one of a first drive shaft subject to die cushion load control by the die cushion load controller and a second drive shaft subject to die cushion position control by the die cushion position controller, and during the specific die cushion load control process, the die cushion load controller controls the first drive shaft selected by the selector, and the die cushion position controller controls the second drive shaft selected by the selector.

According to the other aspect of the present invention, the second drive shaft selected as a drive shaft not subject to the die cushion load control is controlled by the die cushion position controller. Thus, it is possible to prevent a die cushion load which tilts the cushion pad from the second drive shaft The die cushion device according to still another aspect of the present invention further includes a plurality of die cushion position detectors configured to detect positions of the cushion pad corresponding to positions of the drive shafts of the plurality of cushion pad raising and lowering devices in a raising-lowering direction, and output respective position detection values indicating the detected positions, wherein, during the specific die cushion load control process, the die cushion position controller controls the second drive shaft based on a position detection value detected by a die cushion position detector corresponding to the first drive shaft. Thus, the position of the second drive shaft controlled by the die cushion position controller can be matched with the position of the first drive shaft controlled by the die cushion load controller so that tilting of the cushion pad can be prevented.

In the die cushion device according to still another aspect of the present invention, it is preferable that the die cushion position controller uses, as a target value, the position detection value detected by the die cushion position detector corresponding to the first drive shaft adjacent to the second drive shaft, or uses, as a target value, a mean value of two or more position detection values detected by a plurality of die cushion position detectors corresponding to a plurality of first drive shafts.

In the die cushion device according to still another aspect of the present invention, it is preferable that, during the specific die cushion load control process, the die cushion position controller controls the second drive shaft so as to fall within ±2 mm to the target value. This is for causing the tilting of the cushion pad to fall within an allowable range.

In the die cushion device according to still another aspect of the present invention, it is preferable that the plurality of cushion pad raising and lowering devices include a plurality of servo motors configured to drive the respective drive shafts, and the die cushion position controller further configured to: compute a torque command signal for a servo motor corresponding to the second drive shaft based on the target value and the position detection value detected by the die cushion position detector corresponding to the second drive shaft; and add a signal in proportion to a signal acquired by differentiating the target value by time or a signal in proportion to a speed of a slide of a press machine, to the computed torque command signal so as to fall within ±2 mm to the target value. The amount of phase delay is compensated by adding, as a feedforward compensation amount, a signal in proportion to a signal acquired by differentiating the target value by time or a signal in proportion to a speed of the slide of the press machine to the computed torque command signal, so that the position can be controlled to fall within ±2 mm to the target value.

In the die cushion device according to still another aspect of the present invention, it is preferable that the plurality of cushion pad raising and lowering devices include a plurality of servo motors configured to drive the respective drive shafts, and the die cushion position controller further configured to: compute a torque command signal for the servo motor corresponding to the second drive shaft based on the target value and the position detection value detected by the die cushion position detector corresponding to the second drive shaft; and adds a signal in proportion to a signal acquired by differentiating the target value by time or a signal acquired by multiplying a signal in proportion to a speed of a slide of a press machine by a phase lead compensation element, to the computed torque command signal so as to fall within ±2 mm to the target value. The amount of phase delay is compensated by adding, as a feedforward compensation amount, a signal in proportion to a signal acquired by differentiating the target value by time or a signal acquired by multiplying a signal in proportion to a speed of the slide of the press machine by a phase lead compensation element to the computed torque command signal. Particularly, in a case where the signal acquired by differentiating the target value by time or the speed of the slide of the press machine suddenly changes, a specific high frequency component is included. In this case, the phase lead compensation element performs compensation such that the position deviation can be minimized.

The die cushion device according to still another aspect of the present invention may further include a plurality of angular speed detectors configured to respectively detect rotational angular speeds of the plurality of servo motors, wherein the die cushion position controller includes a stabilization controller configured to use angular speed signals detected by the plurality of angular speed detectors as angular speed feedback signals. The stabilization controller improves a phase delay of the loop transfer function (open loop) in the die cushion position control system from the die cushion position command signal including the target value to the position detection value during the specific die cushion load control process, thereby stabilizing the position control function.

In the die cushion device according to still another aspect of the present invention, the plurality of cushion pad raising and lowering devices include: a plurality of hydraulic cylinders including piston rods functioning as the drive shafts; and a plurality of hydraulic pumps/motors configured to causing operating fluid to act on die-cushion load generation side pressurizing chambers of the plurality of hydraulic cylinders, and the plurality of servo motors are axially connected to the plurality of hydraulic pumps/motors.

The invention according to still another aspect is a method for controlling a die cushion device including a plurality of cushion pad raising and method for controlling a die cushion device comprising a plurality of cushion pad raising and lowering devices which include a plurality of drive shafts configured to support a cushion pad, and are configured to drive the respective drive shafts to raise and lower the cushion pad, a die cushion load controller configured to control each of the drive shafts of the plurality of cushion pad raising and lowering devices to generate a die cushion load on the cushion pad, and a die cushion position controller configured to control each of the drive shafts of the plurality of cushion pad raising and lowering devices to control the position of the cushion pad. The method includes: during a specific die cushion load control process, independently selecting, by a selector, each of the drive shafts of the plurality of cushion pad raising and lowering devices, as either one of a first drive shaft subject to die cushion load control by the die cushion load controller and a second drive shaft not subject to the die cushion load control by the die cushion load controller; and during the specific die cushion load control process, controlling only the first drive shaft by the die cushion load controller.

In the method for controlling the die cushion device according to still another aspect of the present invention, the selecting by the selector includes independently selecting each of the drive shafts of the plurality of cushion pad raising and lowering devices, as either one of a first drive shaft subject to die cushion load control by the die cushion load controller and a second drive shaft subject to die cushion position control by the die cushion position controller, and during the specific die cushion load control process, the first drive shaft is controlled by the die cushion load controller and the second drive shaft is controlled by the die cushion position controller.

In the method for controlling the die cushion device according to still another aspect of the present invention, the die cushion device further includes a plurality of die cushion position detectors configured to detect positions of the cushion pad corresponding to positions of the drive shafts of the plurality of cushion pad raising and lowering devices in a raising-lowering direction, and output respective position detection values indicating the detected positions, and during the specific die cushion load control process, the second drive shaft is controlled by the die cushion position controller, based on a position detection value detected by the die cushion position detector corresponding to the first drive shaft.

In the method for controlling the die cushion device according to still another aspect of the present invention, it is preferable that the die cushion position controller uses, as a target value, a position detection value detected by the die cushion position detector corresponding to the first drive shaft adjacent to the second drive shaft, or uses, as a target value, a mean value of two or more position detection values detected by a plurality of die cushion position controllers corresponding to a plurality of first drive shafts.

In the method for controlling the die cushion device according to still another aspect of the present invention, during the specific die cushion load control process, the die cushion position controller controls the second drive shaft so as to fall within ±2 mm to the target value.

In the method for controlling the die cushion device according to still another aspect of the present invention, the specific die cushion load control process includes the specific die cushion load control process includes: a die cushion load control process to be performed in a case where a die is arranged at a deviated position with respect to a center of the cushion pad; or a die cushion load control process to be performed in a case where a blank does not exist on part of the plurality of drive shafts.

According to the present invention, a cushion pad can be controlled so as not to tilt during a die cushion load control process irrespective of arrangement of a die (dies). Thus, the die can be arranged without limitation.

BRIEF DESCRIPTION OF THE DRAWINGS

FIG. 6 is a diagram showing other variations of positions of dies and drive points and so on under die cushion load control or die cushion position control in a case where the specific die cushion load control is performed;

FIG. 7 is a block diagram showing an embodiment of a die cushion control device in the die cushion device shown in FIG. 2;

DETAILED DESCRIPTION OF THE PREFERRED EMBODIMENTS

With reference to attached drawings, preferred embodiments of a die cushion device and a method for controlling the die cushion device according to the present invention are described in detail below.

[Press Machine]

Figure 1:
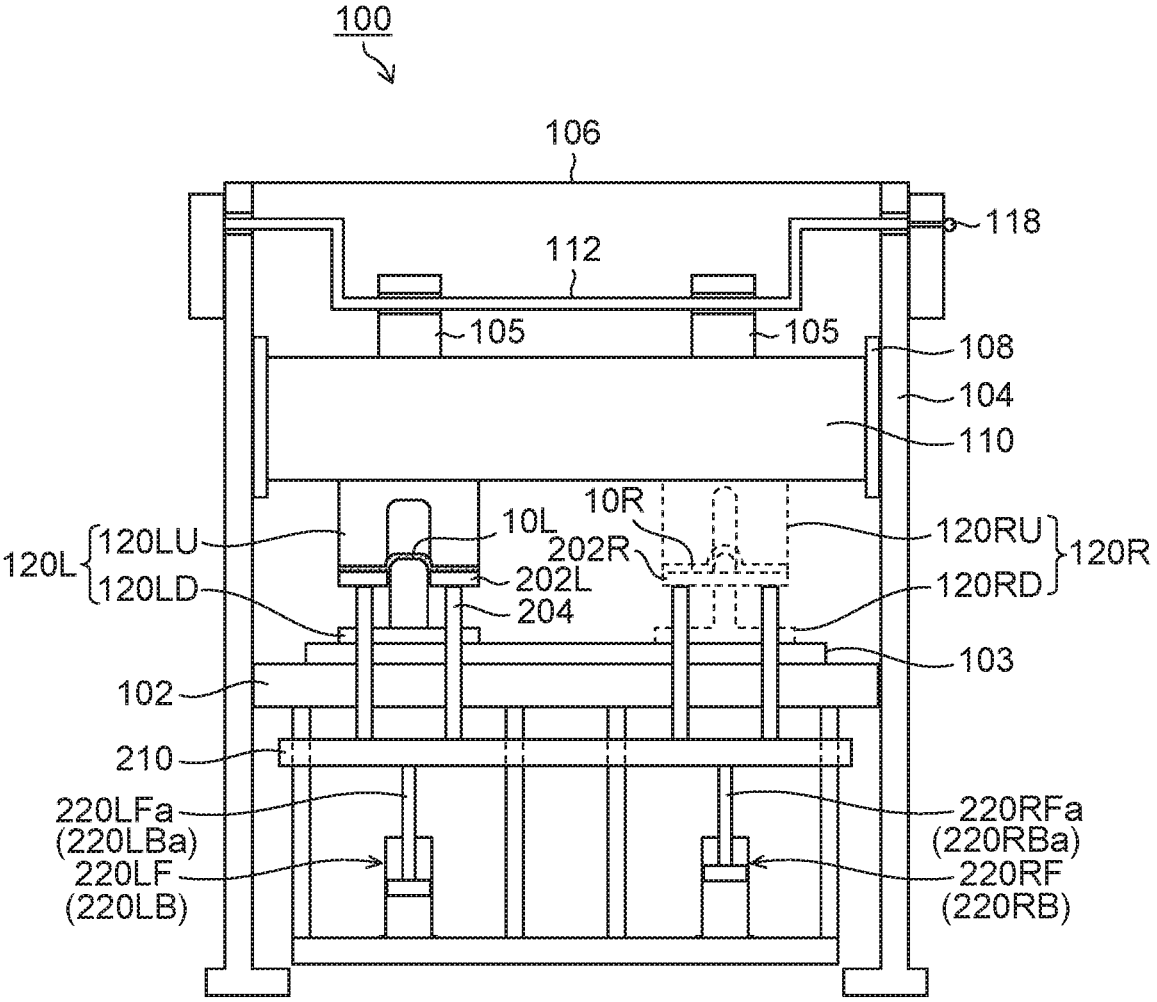
FIG. 1 is a diagram showing a configuration example of a press machine to which the present invention is applied.

FIG. 1 is a diagram showing a configuration example of a press machine to which the present invention is applied.

A press machine 100 shown in FIG. 1 includes a frame having a bed 102, a column 104, and a crown (strength member for an upper part of the frame) 106. A slide 110 is guided movably in an up-down direction (vertical direction) by a guide unit 108 provided in the column 104.

The slide 110 is coupled to a crank axis 112 via a connecting rod 105, and a rotational drive force is transmitted to the crank axis 112 through a drive device (corresponds to parts from a fly wheel to a speed reducer in a mechanical drive device, or parts from a servo motor to a speed reducer in a servo drive device), not shown. The crank axis 112 is rotationally driven by the drive device so that the slide 110 is moved in the up-down direction in FIG. 1.

The crank axis 112 has an encoder 118 that detects an angle of the crank axis 112. A position signal of the slide 110 is converted (detected) based on a crank axis angle signal detected by the encoder 118. The position signal of the slide 110 is differentiated by time so that a speed signal of the slide 110 can be detected.

Two upper dies 120LU and 120RU are attached to the slide 110, and two lower dies 120LD and 120RD corresponding to the two upper dies 120LU and 120RU are attached to a bolster 103 on the bed 102, in this embodiment.

Blankholders (presser plates) 202L and 202R are arranged between the upper dies 120LU and 120RU and the lower dies 120LD and 120RD, respectively. Lower sides of the blankholders 202L and 202R are supported by a cushion pad 210 via a plurality of cushion pins 204, and blanks 10L and 10R are set on upper sides of the blankholders 202L and 202R, respectively.

In the press machine 100, the slide 110 is lowered so that the blanks are press-formed between the upper dies and lower dies. A die cushion device 200, which is described below, presses the periphery of the blanks to be press-formed.

The example shown in FIG. 1 is a case where the two upper dies 120LU and 120RU are attached to the slide 110, and the two lower dies 120LD and 120RD corresponding to the two upper dies 120LU and 120RU are attached to the bolster 103 on the bed 102, and after two kinds of products are simultaneously formed, the die 120R (upper die 120RU and lower die 120RD) on the right side of FIG. 1 is removed, the die 120L (upper die 120LU and lower die 120LD) on the left side is only attached, and the blank 10L is formed only with the die 120L on the left side.

[Die Cushion Device]

Figure 2:
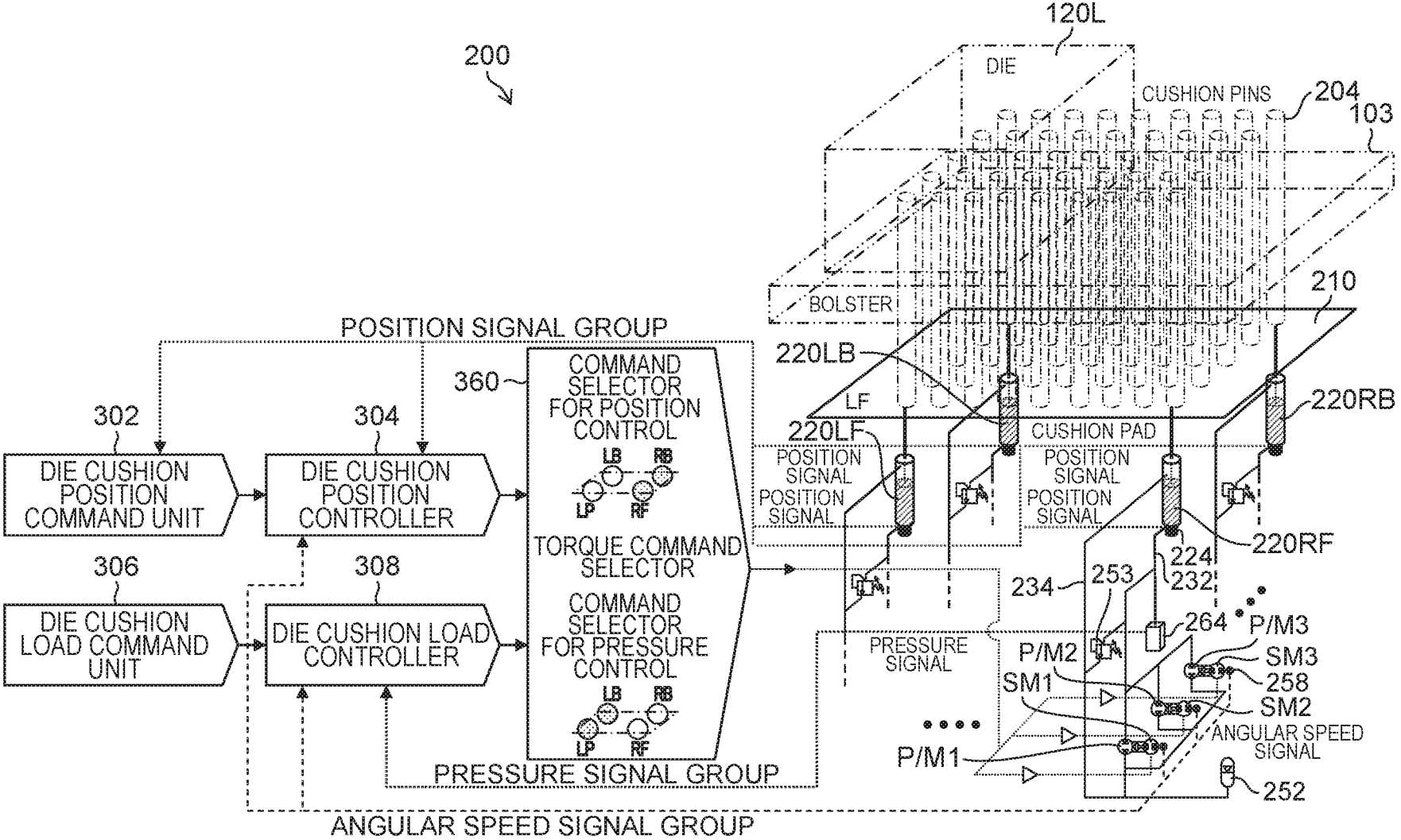
FIG. 2 is a diagram showing an overall configuration of a die cushion device according to the present invention.

FIG. 1 shows a main mechanical part of the die cushion device, and FIG. 2 is a diagram showing an overall configuration of the die cushion device according to the present invention.

In FIG. 1, the die cushion device 200 in this embodiment includes: the cushion pad 210 configured to support the blankholders 202L and 202R via a plurality of cushion pins 204 respectively passing through the bed 102 and the bolster 103 of the press machine 100; and a plurality of hydraulic cylinders 220LF, 220LB, 220RF and 220RB that have a plurality of drive shafts configured to support the cushion pad 210 and drive the respective drive shafts to perform raising/lowering operation on the cushion pad 210.

The four hydraulic cylinders 220LF, 220LB, 220RF and 220RB are arranged at front-left, back-left, front-right and back-right positions, respectively, with respect to the cushion pad 210 as shown in FIG. 2. Piston rods 220LFa, 220LBa, 220RFa and 220RBa for the hydraulic cylinders 220LF, 220LB, 220RF and 220RB function as a plurality of drive shafts which support the cushion pad 210.

As shown in FIG. 2, each of the four hydraulic cylinders 220LF, 220LB, 220RF and 220RB includes an hydraulic system configured to independently drive the corresponding one of the hydraulic cylinders. The four hydraulic cylinders 220LF, 220LB, 220RF and 220RB and the hydraulic systems function as a plurality of cushion pad raising and lowering devices which independently drive the plurality of drive shafts.

Here, because the hydraulic systems that independently drive the hydraulic cylinders have an identical configuration, only the hydraulic system for the front-right hydraulic cylinder 220RF is shown in FIG. 2, and the other hydraulic systems are not shown.

Therefore, the hydraulic system for the front-right hydraulic cylinder 220RF is described below.

As the hydraulic system for the hydraulic cylinder 220RF, a plurality of hydraulic pumps/motors (three hydraulic pumps/motors (P/M1 to P/M3) in this embodiment) are provided. A plurality of servo motors (three servo motors (SM1 to SM3) in this embodiment) are axially connected to rotating shafts of the hydraulic pumps/motors (P/M1 to P/M3), respectively. An angular speed detector 258 is provided in each of the servo motors (SM1 to SM3), and each of the angular speed detectors 258 outputs an angular speed signal indicating a rotational angular speed of the corresponding one of the servo motors (SM1 to SM3).

One port of each of the three hydraulic pumps/motors (P/M1 to P/M3) is connected via a corresponding pipe 232, to a pressurizing chamber on a die-cushion load generation side (raising-side hydraulic chamber) that is one of pressurizing chambers of the hydraulic cylinder 220RF. The other port of each of the three hydraulic pumps/motors (P/M1 to P/M3) is connected via a pipe 234, to the other hydraulic chamber (rod-side hydraulic chamber) of the hydraulic cylinder 220RF and to an accumulator 252 configured to hold a substantially constant low pressure.

Further, in FIG. 2, the hydraulic cylinder 220RF is provided with a die cushion position detector 224 configured to detect a position in the raising-lowering direction of the cushion pad 210 corresponding to the piston rod (drive shaft) and outputs a position detection value indicating the detected position. Note that the die cushion position detector 224 is not limited to the one configured to detect a position of the piston rod (drive shaft) of the hydraulic cylinder but may be one configured to detect a position of the cushion pad 210 near the corresponding drive shaft.

A pipe 232 communicating to the raising-side hydraulic chamber of the hydraulic cylinder 220RF is provided with a pressure detector 264 configured to detect a pressure in the raising-side hydraulic chamber of the hydraulic cylinder 220RF and outputs a pressure signal corresponding to a die cushion load signal.

A low gas pressure is set in the accumulator 252 so that the accumulator 252 acts as a tank. In addition, the accumulator 252 plays a role to supply substantially constant low pressure oil to the raising-side hydraulic chamber of the hydraulic cylinder 220RF via a non-return valve 262 so as to make it easily to increase the pressure under die cushion load control. A relief valve 253 provided in the hydraulic system operates in a case where an abnormal pressure occurs (in a case where the die cushion load control is disabled and a sudden abnormal pressure occurs) and functions as a device which prevents a damage of the hydraulic system.

[Principle of Die Cushion Load Control]

Because a die cushion load acting on each of the drive shafts can be expressed by a product of a pressure in the raising-side hydraulic chamber of the hydraulic cylinder and a cylinder area, controlling the die cushion load means controlling the pressure in the raising-side hydraulic chamber of the hydraulic cylinder.

A statistic behavior can be expressed by Expression 1 and Expression 2, in which a: a cross-sectional area of the raising-side hydraulic chamber of the hydraulic cylinder V: a volume of the raising-side hydraulic chamber of the hydraulic cylinder
P: a die cushion pressure
T: a servo motor torque
I: inertial moment of the servo motor
DM: a viscos resistance coefficient of the servo motor
fM: a friction torque of the servo motor
Q: a displacement volume of an hydraulic motor
$F_{slide}$: a force applied to the piston rod of the hydraulic cylinder from the slide
v: a cushion pad speed caused when pressed by the press
M: an inertial mass of the piston rod of the hydraulic cylinder+cushion pad
DS: a viscos resistance coefficient of the hydraulic cylinder
fS: a frictional force of the hydraulic cylinder
ω: an angular speed of the servo motor rotated when pressed by pressure oil
K: a bulk modulus of elasticity of operating fluid
k1, k2: proportional constants.

$$P=\int K((v\cdot A-3k1Q\cdot\omega)/V)dt \quad \text{[Expression 1]}$$

$$T=k2\cdot PQ/(2\pi) \quad \text{[Expression 2]}$$

A dynamic behavior can be expressed by Expression 3 and Expression 4 in addition to Expression 1 and Expression 2.

$$PA-F=M\cdot dv/dt+DS\cdot v+fS \quad \text{[Expression 3]}$$

$$T-k2\cdot PQ/(2\pi)=I\cdot d\omega/dt+DM\cdot\omega+fM \quad \text{[Expression 4]}$$

What is meant by Expressions 1 to 4, that is, a force transmitted from the slide 110 to the drive shaft of the hydraulic cylinder via the cushion pad 210 compresses the raising-side hydraulic chamber of the hydraulic cylinder and generates die cushion pressure. At the same time, because of the die cushion pressure, the hydraulic pumps/motors (P/M1 to P/M3) are caused to serve as an hydraulic motor. When the rotating shaft torque occurring in the hydraulic pumps/motors (P/M1 to P/M3) becomes equal to the drive torque of the servo motors (SM1 to SM3), the servo motors (SM1 to SM3) are rotated, and an increase of the pressure is suppressed. As a result, the die cushion pressure (die cushion load) is determined in accordance with the drive torque of the servo motors (SM1 to SM3).

A die cushion control device for the die cushion device 200 shown in FIG. 2 includes a die cushion position command unit 302, a die cushion position controller 304, a die cushion load command unit 306, a die cushion load controller 308, and a torque command selector 360.

The die cushion control device determines whether the slide 110 is in a non-pressing process region or in a pressing process region from a position signal of the slide 110 calculated based on a crank axis angle signal detected by the encoder 118. In a case where the slide 110 is in the non-pressing process region, the die cushion control device switches to a die cushion position control mode to be performed by the die cushion position controller 304. In a case where the slide 110 is in the pressing process region, the die cushion control device switches to a die cushion load control mode to be performed by the die cushion load controller 308.

The die cushion position controller 304 generates a position-control command signal (torque command signal) for driving each of the servo motors based on a die cushion position command signal output from the die cushion position command unit 302 and a position signal (position detection value) of the cushion pad of each of the drive shafts detected by the die cushion position detector 224, outputs the generated torque command signal to the servo motors (SM1 to SM3) through the torque command selector 360 and an amplifier, so as to control the positions corresponding to the drive shafts of the cushion pad 210. Note that the die cushion position controller 304 receives an angular speed signal group indicating angular speeds (servo motor angular speeds (w)) of the respective servo motors (SM1 to SM3), which are detected by the angular speed detector 258, and uses the angular speed signal group as angular speed feedback signals for acquiring dynamic stability of the die cushion position.

It is preferable that, in order to acquire the dynamic stability, the servo motors (SM1 to SM3) are speed-controlled and that the cushion pad 210 is position-controlled in the raising-lowering direction.

In a case where a specific die cushion load control process, which is described below, is performed, in order to perform position control over a drive shaft (second drive shaft) selected as a drive shaft subject to die cushion position control among a plurality of drive shafts (four drive shafts at front-left, back-left, front-right and back-right in this embodiment), the die cushion position controller 304 generates a torque command signal corresponding to the second drive shaft during the specific die cushion load control process.

The die cushion load controller 308 generates a pressure-control command signal (torque command signal) for driving each servo motor based on a die cushion load command signal for each drive shaft, which is applied from the die cushion load command unit 306, and a pressure signal indicating the pressure in the raising-side hydraulic chamber of each hydraulic cylinder, which is detected by the pressure detector 264. Then, the die cushion load controller 308 outputs the generated torque command signal to each servo motor (SM1 to SM3) through the torque command selector 360 and the amplifier, and controls the die cushion load to be applied to each drive shaft of the cushion pad 210. Note that the die cushion load controller 308 receives the angular speed signal group of the servo motors (SM1 to SM3), which are detected by the angular speed detector 258, and uses the angular speed signal group as angular speed feedback signals for acquiring the dynamic stability of the die cushion loads.

In the case of the specific die cushion load control process, the die cushion load controller 308 performs die cushion load control only over a drive shaft (first drive shaft) selected as a drive shaft subject to the die cushion load control among the plurality of drive shafts during the specific die cushion load control process.

The torque command selector 360 basically selects a torque command signal generated by the die cushion position controller 304 in a case where the slide 110 is in the non-pressing process region, and selects a torque command signal generated by the die cushion load controller 308 in a case where the slide 110 is in the pressing process region. Then, the torque command selector 360 outputs the selected torque command signal to the subsequent amplifier.

In the case of the specific die cushion load control process, the torque command selector 360 does not select the torque command signal for performing the die cushion load control over each of the plurality of drive shafts, but instead selects and outputs only the torque command signal generated for the first drive shaft selected as a drive shaft subject to the die cushion load control among the plurality of drive shafts. In addition, the torque command selector 360 selects and outputs the torque command signal generated by the die cushion position controller 304, for the second drive shaft selected as a drive shaft subject to the die cushion position control among the plurality of drive shafts.

[Application Example of Specific Die Cushion Load Control]

Here, it is assumed that, in a tandem line of a press machine for producing a body of an automobile, a part (No. 5) of a body region of a certain car type is produced by using the press machine 100, the die cushion device 200 (FIG. 1 and FIG. 2) and so on.

Figure 3:
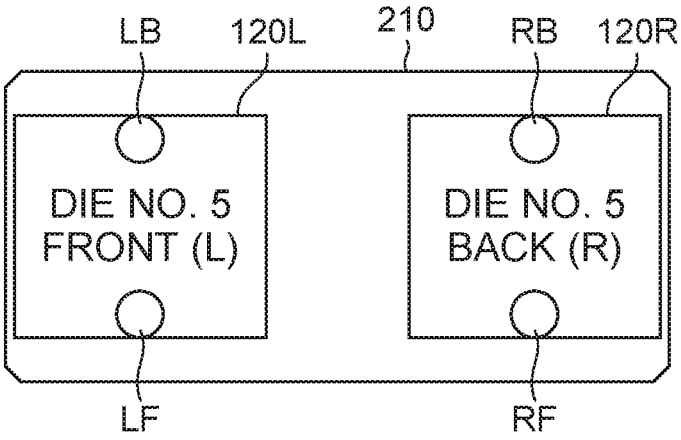
FIG. 3 is a diagram showing positions at four drive points LF, LB, RF and RB with respect to a cushion pad 210 and a relationship of positions of left and right dies 120L and 120R.

FIG. 3 is a diagram showing positions at four drive points LF, LB, RF and RB with respect to the cushion pad 210, and a relationship of positions of left and right dies 120L and 120R.

The part of the body region includes two parts of a front part (No. 5L) and back part (No. 5R) as shown in FIG. 3, and a die 120L for the front part and a die 120R for the back part are respectively attached to the left and right sides of the press machine 100. Thus, the parts are simultaneously produced.

The cushion pad 210 is 4-point driven, and a die cushion load of 1000 kN is set for each of the shafts (that is, 2000 kN as the left die cushion load, 2000 kN as the right die cushion load, and 4000 kN as the total die cushion load). The die cushion stroke is 200 mm.

The drive shafts that independently drive the four drive points LF, LB, RF and RB are piston rods for the hydraulic cylinders 220LF, 220LB, 220RF and 220RB each of which are driven by the hydraulic pumps/motors (P/M1 to P/M3) axially connected to the three servo motors (SM1 to SM3), respectively. The plate thickness of the blank is 1.2 mm on the left and 1.6 mm on the right.

It is assumed that a problem happened when a predetermined number of (such as 5000) parts were produced and the production was completed. In quality inspection on products which was performed substantially simultaneously with (or slightly delayed from) the production in a post-process of the press line, damages (defects) were found at partial areas on surfaces of a plurality of (such as 45) front parts (L). All of the back parts (R) were normal.

In this case, before another part production with the next dies is started, 45 front parts (L) must be immediately additionally produced to compensate for the 45 defective front parts (L) (condition X). In this condition X, if the left and right parts were simultaneously produced (two parts at one cycle) with the left and right dies 120L and 120R, it is impossible to produce left parts only, and unnecessary right parts had to be produced at the same time (condition Y).

This is because, when no-load striking is performed without setting a blank on the right side, the cushion pad 210 tilts (so as to lower the left side of the cushion pad) by an amount equal to the plate thickness of the blank (after consideration of press-forming of the blank), resulting in troubles such as failure in the production of the left parts and damage on the machine (for example, each drive shaft that drives the cushion pad 210).

<Outline of the Present Invention>

The present invention performs specific die cushion load control. For example, under the condition X, even in the press machine which produces left and right parts simultaneously (two parts at one cycle), the present invention enables to continuously use only the left die 120L so as to favorably produce only the left parts, thereby preventing production of unnecessary of unnecessary right parts (condition Z).

Figure 4A:
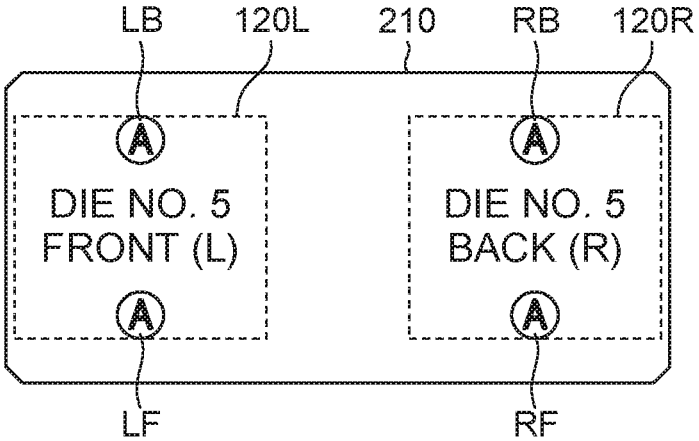
FIGS. 4A and 4B are diagrams showing positions of dies and drive points and so on under die cushion load control or die cushion position control in a case where normal die cushion load control is performed and in a case where specific die cushion load control is performed.
Figure 4B:
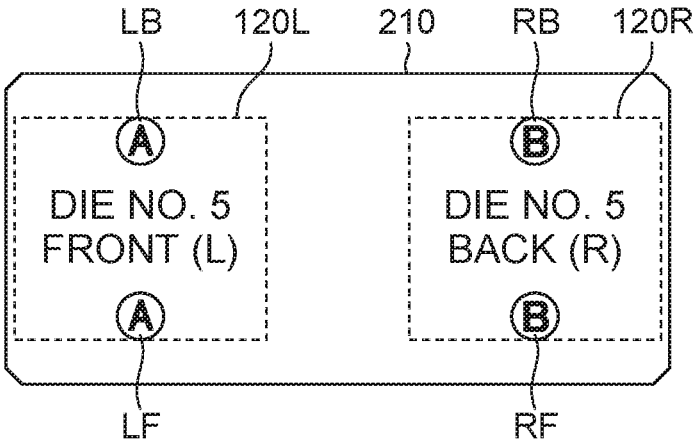

FIGS. 4A and 4B are diagrams showing positions of dies and drive points and so on under die cushion load control or die cushion position control in a case where normal die cushion load control is performed and in a case where the specific die cushion load control is performed.

FIG. 4A shows a case where normal production is performed in which left and right parts are simultaneously produced, and FIG. 4B shows a case of the condition Z in which only the left part is produced. In FIGS. 4A and 4B, a symbol A written within a circle indicates a drive point where the die cushion load control is performed, and a symbol B written within a circle indicates a drive point where the die cushion position control is performed.

In the case of the normal production shown in FIG. 4A, four drive points LF, LB, RF and RB for the cushion pad 210 are all the drive points A where the die cushion load control is performed during the die cushion load control process.

On the other hand, in the case of the condition Z shown in FIG. 4B, the drive points LF and LB corresponding to the left die 120L among the four drive points LF, LB, RF and RB are the drive points A where the die cushion load control is performed, and the drive points RF and RB corresponding to the right die 120R are the drive points B where the die cushion position control is performed, during the die cushion load control process.

In other words, in the case of the condition Z shown in FIG. 4B, the specific die cushion load control is performed in which the die cushion load control is performed only over a drive shaft (first drive shaft) selected as a drive shaft subject to the die cushion load control among a plurality of drive shafts which drive the cushion pad during the die cushion load control process.

Under the specific die cushion load control, the die cushion position control is performed during the die cushion load control process on drive shafts (second drive shafts) excluding the first drive shaft among the plurality of drive shafts. The die cushion position control in this case is performed by using, as a target value for position control, a die cushion (cushion pad) position of the first drive shaft adjacent to the second drive shafts subject to the die cushion position control.

In the case of the condition Z, when an operator presses a button of a "PRODUCE LEFT SIDE ONLY" on a die cushion operation screen, not shown, the specific die cushion load control is performed so that only the left die 120L is used and only the left part is produced.

Thus, without setting a blank on the right side (and further without attaching the die to the right side), a force which holds the cushion pad 210 in a parallel state at all times during the forming process acts on the drive shafts corresponding to the two right drive points RF and RB. Therefore, the production of only the left part is performed favorably, and the machine (drive shafts that drive the cushion pad 210) is not damaged.

Figure 5:
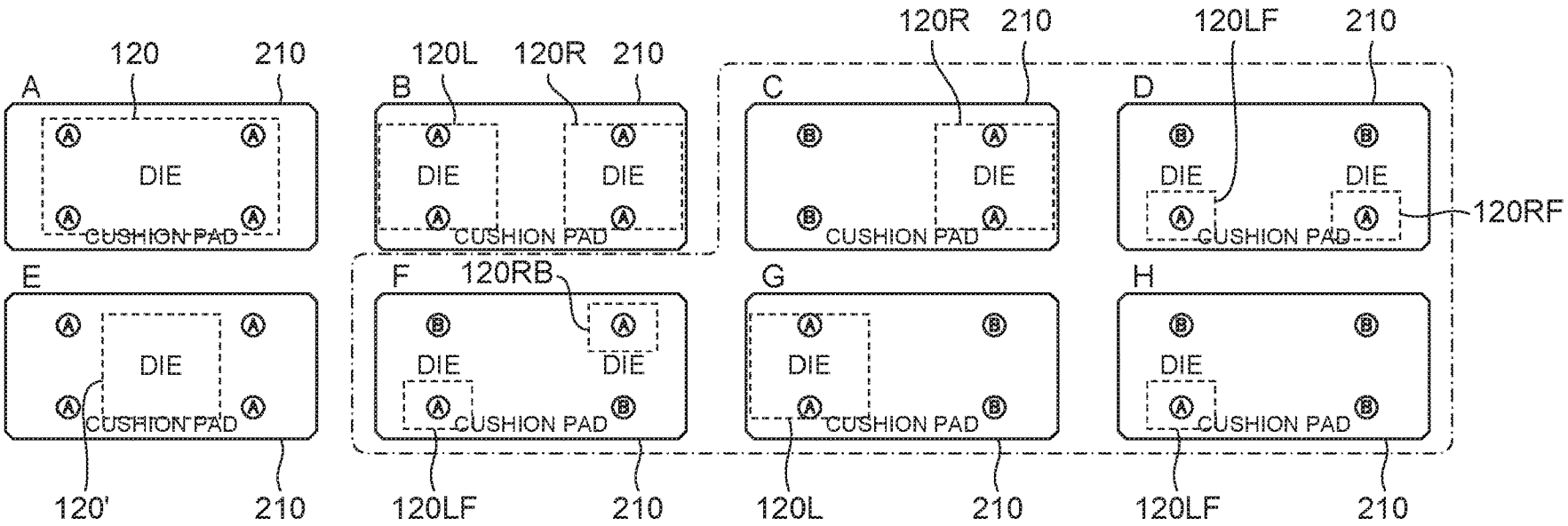
FIG. 5 is a diagram showing variations of positions of dies and drive points and so on under die cushion load control or die cushion position control in a case where the normal die cushion load control is performed and in a case where the specific die cushion load control is performed.

FIG. 5 shows variations A to H of the positions of the dies and drive points and so on, under the die cushion load control or the die cushion position control, in a case where the normal die cushion load control is performed and in a case where the specific die cushion load control is performed.

The variations A, B and H show positions and so on, of the dies (120, 120L, 120R, 120', 120LF, 120RB) with respect to the cushion pad 210 in a case where the normal die cushion load control is performed. When the dies are positioned in the shown manners, all of the four drive points are the drive points A where the die cushion load control is performed during the die cushion load control process.

On the other hand, the variations C, D, F, G and H show positions and so on of the dies (120R, 120LF, 120RF and 120RB) with respect to the cushion pad 210 in a case where the specific die cushion load control is performed. The specific die cushion load control process includes: a die cushion load control process in a case where a die is arranged at a deviated position with respect to the center of the cushion pad 210; or a die cushion load control process in a case where a blank does not exist on one or some of the plurality of drive shafts.

The variation G corresponds to the example shown in FIG. 4B and shows the position and so on of the die 120L in a case where only a left part is produced. The drive points on the left side are the drive points A corresponding to the first drive shafts subject to the die cushion load control during the die cushion load control process. The drive points on the right side are the drive points B corresponding to the second drive shafts subject to the die cushion position control during the die cushion load control process, with the die cushion positions of the respective adjacent drive points A on the left side used as target values for position control.

The variation C shows the position and so on of the die 120R when only a right part is produced, conversely to the variation G. The drive points on the right side are the drive points A corresponding to the first drive shaft subject to the die cushion load control during the die cushion load control process. The drive points on the left side are the drive points B corresponding to the second drive shaft subject to the die cushion position control during the die cushion load control process, with the die cushion positions of the respective adjacent drive points A on the right side used as target values for position control.

Each of the variations D, F and H has one drive point within a projection plane of the corresponding die (120LF, 120RF, 120RB), and the drive point is the drive point A corresponding to the first drive shaft subject to the die cushion load control during the die cushion load control process. The other drive points are the drive points B corresponding to the second drive shaft subject to the die cushion position control during the die cushion load control process, with the die cushion positions of the adjacent drive points A used as target values for position control.

FIG. 6 is a diagram showing other variations I and J of the positions of the dies and drive points and so on under the die cushion load control or die cushion position control in a case where the specific die cushion load control is performed.

Each of the variations I and J shown in FIG. 6 has cushion pads 210L and 210R which are two divisions in the left-right direction. Each of the variations I and J is applied to a die cushion device that drives each of the cushion pads 210L and 210R through four drive shafts. Dies 120 and 120' are arranged at positions across the left and right cushion pads 210L and 210R.

The variation I has four drive points inside of a projection plane of the die 120. These drive points are the drive points A corresponding to the first drive shafts subject to die cushion load control during the die cushion load control process. The drive points outside of the projection plane of the die 120 are the drive points B corresponding to the second drive shafts subject to the die cushion position control during the die cushion load control process with the die cushion positions of the adjacent drive points A used as target values for position control.

In the variation J, a front-right drive point of the left cushion pad 210L and a front-left drive point of the right cushion pad 210R are close to the die 120', and the two drive points are the drive points A corresponding to the first drive shafts subject to die cushion load control during the die cushion load control process. The other drive points are the drive points B corresponding to the second drive shafts subject to the die cushion position control during the die cushion load control process, with the die cushion positions of the adjacent drive points A used as target values for position control.

[Die Cushion Control Device]

FIG. 7 is a block diagram showing an embodiment of the die cushion control device in the die cushion device 200 shown in FIG. 2. Note that die cushion load control in the die cushion control device is described assuming a case where the specific die cushion load control is performed so that only a left part is produced with the die 120L because of the condition X.

As shown in FIG. 7, the die cushion control device includes: the die cushion position command unit 302; the die cushion load command unit 306; and four die cushion controllers (a front-left die cushion controller 300LF, a front-right die cushion controller 300RF, a back-left die cushion controller 300LB and a back-right die cushion controller 300RB) respectively corresponding to the four front-left, back-left, front-right and back-right drive shafts.

Because the four die cushion controllers have the same configuration, FIG. 7 shows only the front-right die cushion controller 300RF in detail.

The front-right die cushion controller 300RF includes the die cushion position controller 304, the die cushion load controller 308 and the torque command selector 360.

If it is determined that the slide 110 is in the non-pressing process region based on a position signal of the slide 110 calculated based on a crank axis angle signal detected by the encoder 118, the die cushion position command unit 302 outputs a position command value of the cushion pad 210 based on the position signal of the slide 110.

In this embodiment, the die cushion position command unit 302 outputs a position command value indicating a cushion pad standby position during position control for causing the cushion pad 210 to stand by at a preset cushion pad standby position. In addition, the die cushion position command unit 302 outputs a position command value that causes the cushion pad 210 to preliminarily accelerate in a case where the cushion pad 210 is preliminarily accelerated from the cushion pad standby position in order to reduce impact (force) upon collision during a die cushion load action. Further, the die cushion position command unit 302 outputs a position command value to perform a product knock-out operation and cause the cushion pad 210 to return to the die cushion standby position in a case where the slide 110 reaches the bottom dead point and the die cushion load control ends.

The die cushion position controller 304 includes a position command selector 310, a position controller 320, a stabilization controller 330, a feedforward compensator 350 and adders 341 to 343.

The position command selector 310 selects either one of a position command value from the die cushion position controller 304 to be applied to an input A and a position signal (position detection value) of the cushion pad 210 at the drive point LF of the front-left drive shaft, which is detected by the die cushion position detector 224, to be applied to an input B. Here, the position detection value to be applied to the input B is a position detection value at the front-left drive point LF adjacent to the drive point RF of the front-right die cushion controller 300RF. Here, the front-left drive point LF is a drive point subject to the die cushion load control during the specific die cushion load control process.

The position command selector 310 changes a switch SWpr to the input A and selects the position command value input from the die cushion position controller 304 in a case where process other than the die cushion load control process is performed and in a case where the front-right drive shaft is selected as the first drive shaft subject to the die cushion load control during the die cushion load control process. In addition, the position command selector 310 changes the switch SWpr to the input B and selects the position detection value of the front-left drive shaft as a target value (position command value) for the die cushion position control in a case where the front-right drive shaft is selected as the second drive shaft subject to the die cushion position control during the die cushion load control process.

In this embodiment, because the left part is only produced with the die 120L because of the condition X, the position command selector 310 selects the front-right drive shaft as the second drive shaft subject to the die cushion position control during the die cushion load control process, and selects and outputs the position detection value of the front-left drive shaft as the position command value.

The position controller 320 has a subtractor 322 and a position control compensator 324. The subtractor 322 has a positive input to which the position command value selected by the position command selector 310 is applied and a negative input to which the position detection value of the front-right drive point RF of the cushion pad 210, which is detected by the front-right die cushion position detector 224, is applied. The subtractor 322 computes a deviation (position deviation) of the position detection value with respect to the position command value and outputs the computed position deviation to the position control compensator 324 so as to reduce the position deviation.

The position control compensator 324 adds, for example, a compensation amount in proportion to the integral quantity of the position deviation to a compensation amount in proportion to the position deviation, and computes a signal that promotes the reduction of the position deviation.

The stabilization controller 330 has three subtractors (331A to 333A) and three stabilization control compensators (331B to 333B). In a case where only the position controller 320 is provided in the die cushion position controller 304, there is a problem that the position control function becomes instable because the loop transfer function (open loop) of the die cushion position control system from the position command value to the position detection value has an large phase delay. The stabilization controller 330 plays a role to improve the problem.

Each of the subtractors (331A to 333A) has a positive input to which a signal computed by the position controller 320 is applied and a negative input to which an angular speed signal (FR1 to FR3) indicating the angular speed of the corresponding servo motor (SM1 to SM3) detected by the angular speed detector 258 is applied as an angular speed feedback signal. Each of the subtractors (331A to 333A) computes a deviation (angular speed deviation) of two input signals and outputs the computed angular speed deviation to the corresponding stabilization control compensator (331B to 333B).

Each of the stabilization control compensators (331B to 333B) computes a signal that promotes reduction of the angular speed deviation computed by the corresponding one of the subtractors (331A to 333A) by, for example, adding a compensation amount in proportion to the integral quantity of an angular speed deviation to the compensation amount in proportion to the angular speed deviation.

The signals computed by the stabilization control compensators (331B to 333B) are output to the adders (341 to 343) as torque command signals for the servo motors (SM1 to SM3), respectively.

The feedforward compensator 350 has a differential element 352, a phase lead compensation element 354, an adjuster 356 and switches SWf1 and SWf2 The feedforward compensator 350 plays a role to reduce a deviation between a position command value and a position detection value during the position control over the cushion pad 210. In particular, in the front-right feedforward compensator 350, during the die cushion load control process, the switch SWf1 is turned on in a case where the front-right drive shaft is selected as the second drive shaft subject to the die cushion position control, and the feedforward compensation functions.

In a case where a position detection value (position command value) of the input B is selected by the position command selector 310, the differential element 352 in the feedforward compensator 350 outputs a result acquired by differentiating the position command value by time. Here, the transfer function of the differential element 352 is $\omega aS/(S+\omega a)$ rather than simply S (where S is a Laplacian operator). The reason why the differentiation is multiplied by a low-pass filter with the angular frequency $\omega a$ is to smoothly process the temporal differentiation operation within a limited computation period in digital (discrete value) computing.

The differentiation signals of the die cushion position (die cushion position command) signals for the front-left and back-left drive shafts during the die cushion load control process are substantially equivalent to the slide speed signal during the die cushion load control process, and the differentiation signal of the die cushion position signal and the slide speed signal can be used interchangeably.

The die cushion position signal includes specific high frequency components and the phase compensation element functioning within the feedforward compensator 350 performs compensation for the specific high frequency component such that the position deviation can be minimized, in the following cases: in a case where the upper die 120LU on the left side collides with the cushion pad 210 through the blank 10L, blankholder 202 in the lower die 120LD and the cushion pins 204; in a case where the upper die 120LU and the lower die 120LD are brought into torso-contact (body-contact) in vicinity of the bottom dead center so that the press frame starts to extend and the forming of the left part completes and then the die cushion load on the left side is unloaded; and in a case where the position detection value of the front-left drive shaft functioning as the position command value for the front-right drive shaft and the position detection value of the back-left drive shaft rapidly change.

The phase lead compensation element 354 is a compensation element that advances the phase of an input signal, and the transfer function thereof is expressed by $(1+T_2 \cdot S)/(1+T_1 \cdot s)$. $T_1$ and $T_2$ (where $T_1<T_2$) are constants and are preferably set as required in accordance with specific high frequency components.

The phase lead compensation element 354 is not arranged in series with the compensation elements forming a closed loop such as the position controller 320 and the stabilization controller 330. Instead, the phase lead compensation element 354 has characteristic in that it is arranged in series with the feedforward compensator 350 which forms an open loop. Thus, the position control system itself does not amplify noise so that it does not become instable.

The switch SWf2 selects an input x to which an output signal from the differential element 352 is applied or an input y to which an output signal from the differential element 352 and an output signal from the phase lead compensation element 354 are applied. Then, the switch SWf2 outputs the selected signal to the subsequent adjuster 356. Note that the switch SWf2 is switched to the input y for a predetermined period upon start and end of the die cushion load control process, and is switched to the input x during the other periods. Details of the changing timing of the switch SWf2 are described below.

The adjuster 356 adjusts a gain of a signal input thereto via the switch SWf2. The differential element 352 and the adjuster 356 compensate an amount of phase delay of the servo motor angular speed signal with respect to the output signal from the position control compensator 324 (in appearance, corresponding to the speed command signal of the servo motor), which is a cost (side effect) of the stabilization by the stabilization controller 330.

The switch SWf1 is turned on during the die cushion load control process in a case where the front-right drive shaft is selected as the second drive shaft subject to the die cushion position control as described above and causes the front-right feedforward compensator 350 to function. The output signal output from the feedforward compensator 350 via the switch SWf1 is output to the adders (341 to 343).

Signals computed by the stabilization control compensators (331B to 333B) in the stabilization controller 330 are applied to the other inputs of the adders 341 to 343 as torque command signals for the servo motors (SM1 to SM3). In a case where the feedforward compensator 350 functions (that is, the switch SWf1 is turned on), the adders 341 to 343 respectively add an output signal from the feedforward compensator 350 to the torque command signals for the respective servo motors (SM1 to SM3) and output the addition results to the torque command selector 360. In a case where the feedforward compensator 350 does not function (that is, the switch SWf1 is turned off), the adders 341 to 343 directly output the torque command signals for the respective servo motors (SM1 to SM3) computed by the respective stabilization control compensators (331B to 333B), to the torque command selector 360.

The torque command signals for the servo motors (SM1 to SM3) generated by the die cushion load controller 308 are applied to the other input F of the torque command selector 360.

The torque command selector 360 selects the torque command signals generated by the die cushion position controller 304 basically in a case where the slide 110 is in the non-pressing process region. The torque command selector 360 selects the torque command signals generated by the die cushion load controller 308 and outputs the selected torque command signals (RF1 to RF3) to the respective servo motors (SM1 to SM3) through the amplifier in a case where the slide 110 is in the pressing process region.

Also, the torque command selector 360 functions as a selector that selects the front-right drive shaft for the cushion pad 210, as either one of the first drive shaft subject to the die cushion load control by the die cushion load controller 308 and the second drive shaft subject to the die cushion position control by the die cushion position controller 304.

In other words, the torque command selector 360 in the front-right die cushion controller 300RF for the front-right drive shaft on which the specific die cushion load control process is performed selects the torque command signal on the input P side, which is generated by the die cushion position controller 304, also during the die cushion load control process so as to select the front-right drive shaft as the second drive shaft subject to the die cushion position control.

On the other hand, because the die cushion load controller 308 for each of the drive shafts is not directly related to the gist of the present invention, the die cushion load controller 308 is briefly described below.

The die cushion load command signal from the die cushion load command unit 306 and a pressure signal from the pressure detector 264 that detects a pressure in the raising-side hydraulic chamber of the front-right hydraulic cylinder 220RF corresponding to the front-right drive shaft are applied to the die cushion load controller 308 in the front-right die cushion controller 300RF.

The die cushion load controller 308 generates a pressure-control command signal (torque command signal) for driving each of the three servo motors (SM1 to SM3) provided correspondingly to the front-right hydraulic cylinder 220RF based on the input die cushion load command signal and the pressure signal, and outputs the generated torque command signal to the torque command selector 360.

The die cushion load controller 308 has a stabilization controller, not shown, like the stabilization controller 330 in the die cushion position controller 304, and uses angular speed signals (FR1 to FR3) indicating angular speeds of the servo motors (SM1 to SM3) in order to generate the torque command signals for driving the respective servo motors (SM1 to SM3).

The die cushion load controller 308 in the front-right die cushion controller 300RF generates a torque command signal which is used for causing the front-right hydraulic cylinder 220RF to generate a die cushion load. However, in this embodiment, because the front-right hydraulic cylinder 220RF is subject to the die cushion position control during the die cushion load control process (because the torque command selector 360 selects a torque command signal from the die cushion position controller 304), the operation of generating a torque command signal by the die cushion load controller 308 may be stopped.

In this embodiment, the back-right die cushion controller 300RB performs position control over the back-right hydraulic cylinder 220RB by using the torque command signal from the die cushion position controller 304 during the die cushion load control process like the front-right die cushion controller 300RF.

On the other hand, each of the front-left die cushion controller 300LF and the back-left die cushion controller 300LB performs the normal die cushion load control by using the torque command signal from the die cushion load controller 308 during the die cushion load control process.

[Operations by Die Cushion Device]

Next, with reference to FIGS. 8 to 12, operations by the die cushion device 200 are described. FIGS. 8 to 12 are diagrams showing main physical quantity with respect to elapsed time in a forming (die cushion load control) process and a product knock-out process in a case where only a left part is produced (in the case of the condition Z).

Figure 8:
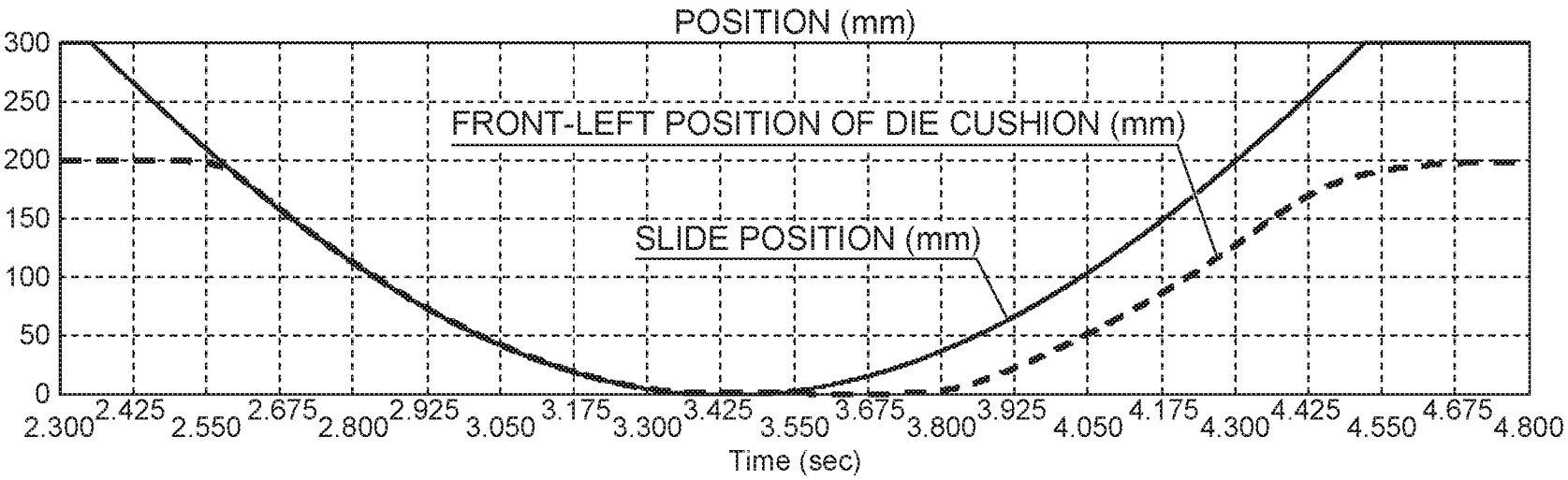
FIG. 8 is a waveform diagram showing a slide position and a die cushion front-left position in a case where only a left part is produced.

FIG. 8 is a waveform diagram showing a slide position and a die cushion front-left position (front-left position of the die cushion) in a case where only a left part is produced. The die cushion front-left position indicates a cushion pad position corresponding to the front-left drive point for driving with the front-left drive shaft.

Figure 9:
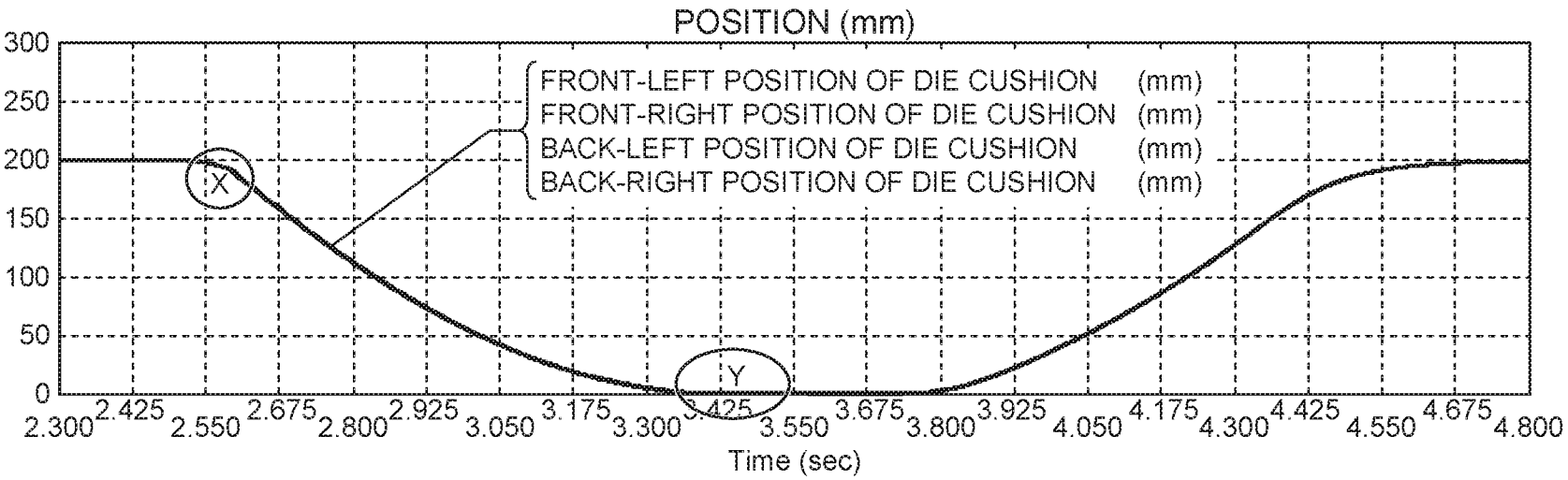
FIG. 9 is a waveform diagram showing the die cushion front-left position, a die cushion front-right position, a die cushion back-left position and a die cushion back-right position in a case where only the left part is produced.

FIG. 9 is a waveform diagram showing a die cushion front-left position, a die cushion front-right position (front-right position of the die cushion), a die cushion back-left position (back-left position of the die cushion) and a die cushion back-right position (back-right position of the die cushion) in a case where only a left part is produced.

These positions, basically throughout the cycle, are position-controlled so as to follow a common die cushion position command signal such as a die cushion start position command or a knock-out position command acquired by integrating the knock-out speed setting at the time of knock-out. However, during the die cushion load control process, the die cushion front-left position and the die cushion back-left position are used as position command values. The die cushion front-right position and the die cushion back-right position, respectively, are positionally controlled so that deviations from the die cushion front-left position and the die cushion back-left position become zero (as much as possible).

Note that, in FIG. 9, the four positions are substantially matched, and the cushion pad 210 is held horizontally.

Figure 10:
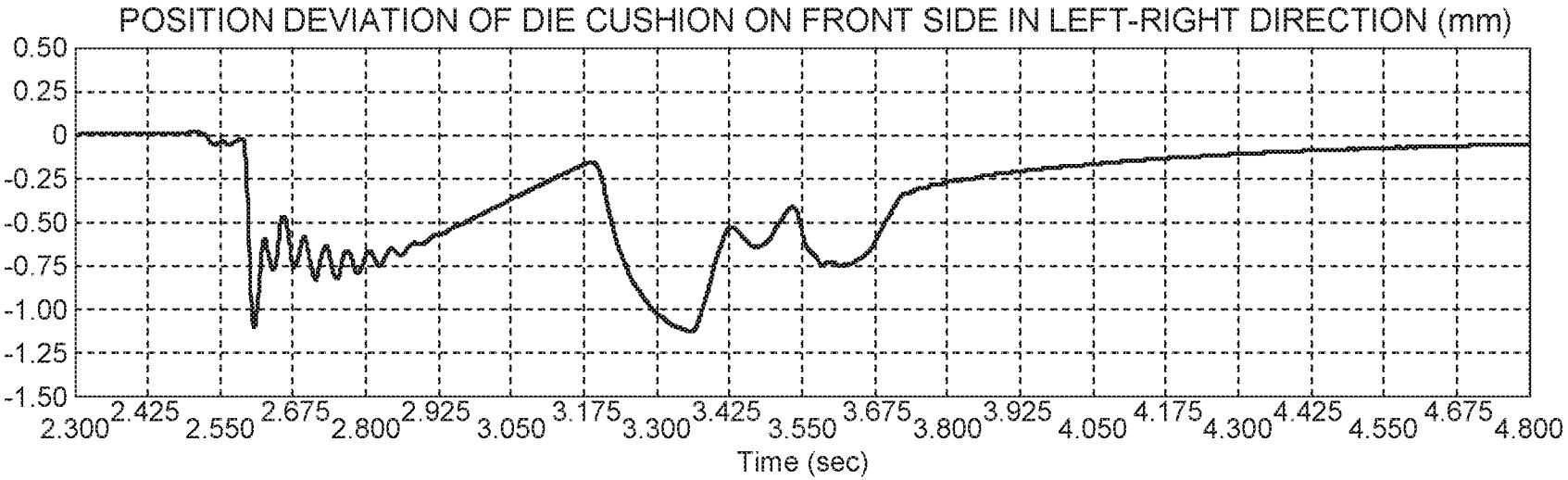
FIG. 10 is a waveform diagram showing a deviation between the die cushion front-left position and the die cushion front-right position (die cushion front-left position-die cushion front-right position) in a case where only the left part is produced.

FIG. 10 is a waveform diagram showing a deviation of the die cushion front-left position and the die cushion front-right position (die cushion front-left position-die cushion front-right position) in a case where only a left part is produced. The absolute value of the deviation fits within approximately 1 mm at a maximum.

Figure 11:
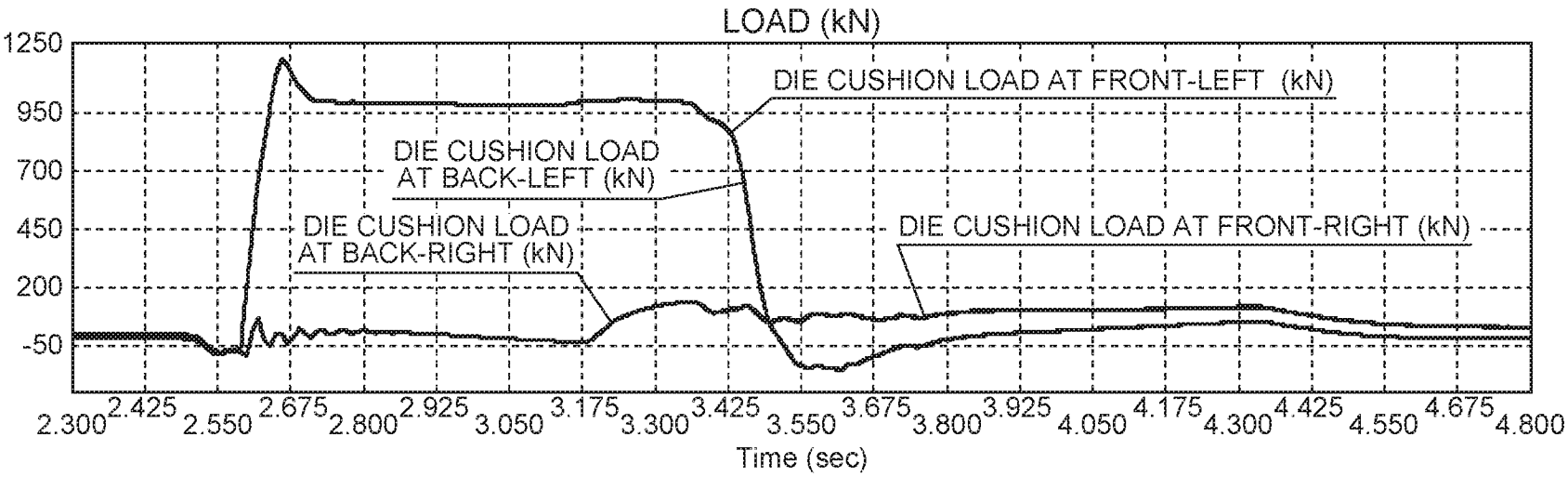
FIG. 11 is a waveform diagram showing loads on respective drive shafts at front-left, front-right, back-left and back-right in a case where only the left part is produced.

FIG. 11 is a waveform diagram showing loads on (front-left, front-right, back-left and back-right) drive shafts in a case where only a left part is produced.

As shown in FIG. 11, the loads on the front-left and back-left drive shafts are substantially matched each other, and the loads on the front-right and back-right drive shafts are substantially matched each other.

Here, regarding the drive shafts (the front-left drive shaft and the back-left drive shaft in this case) subject to the die cushion load control, the loads mean die cushion loads in the die cushion load operation process.

Figure 12:
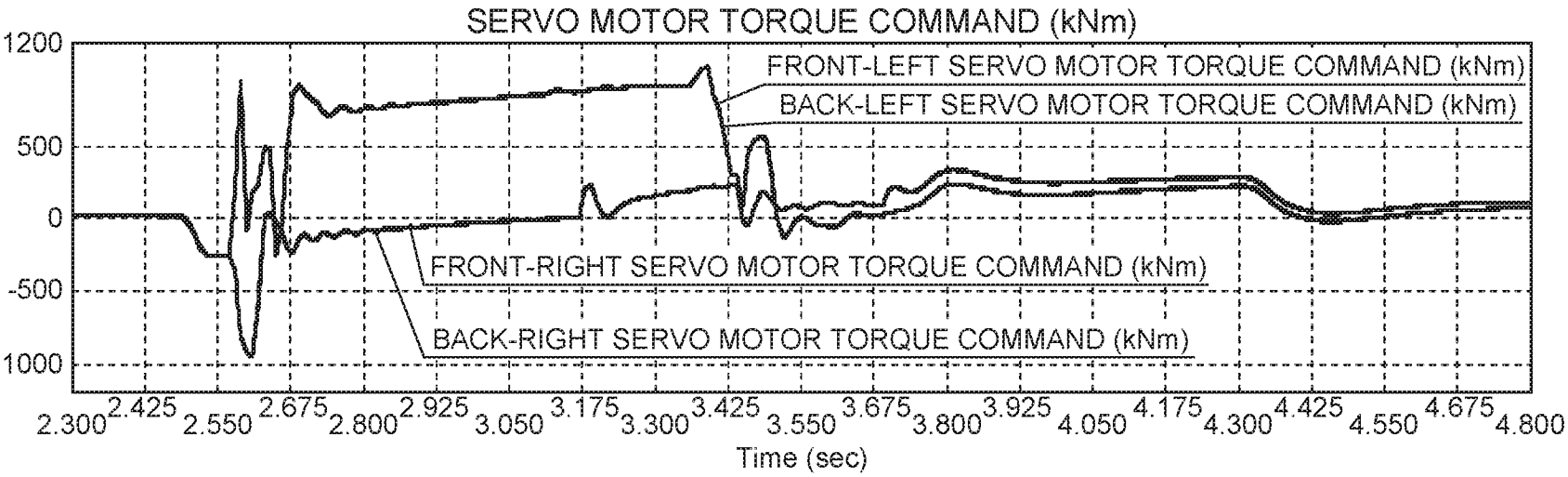
FIG. 12 is a waveform diagram showing torque command signals for a representative one of three servo motors that drive each of the drive shafts in a case where only a left part is produced.

FIG. 12 is a waveform diagram showing torque command signals for a representative one of the three servo motors that drive each of the drive shafts in a case where only a left part is produced.

As shown in FIG. 12, the torque command signals to the servo motors that drive the front-left and back-left drive shafts are substantially matched, and the torque command signals to the servo motors that drive the front-right and back-right drive shafts are substantially matched.

Figure 13:
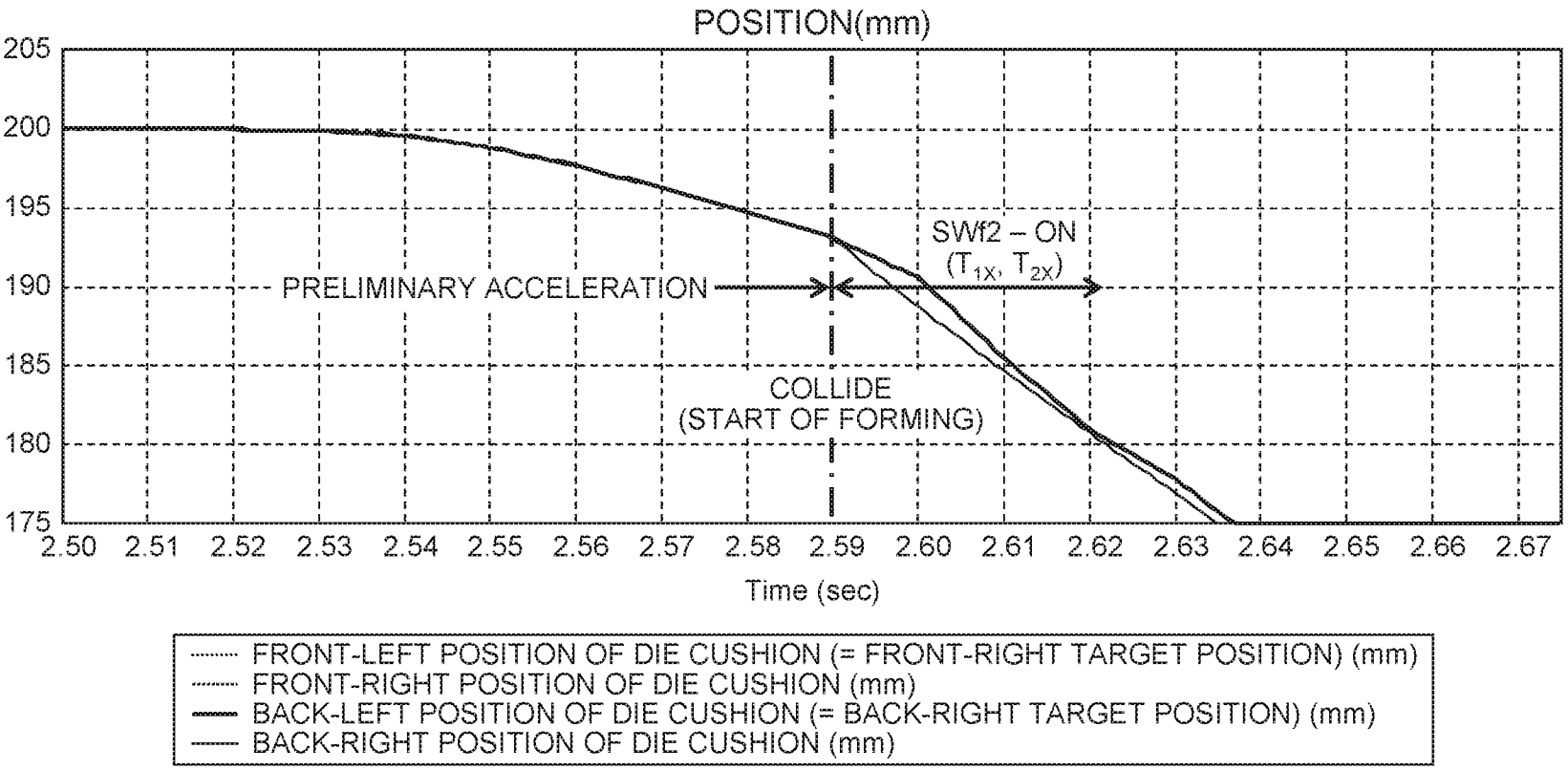
FIG. 13 is an enlarged diagram showing an X part indicated within a circle in FIG. 9.
Figure 14:
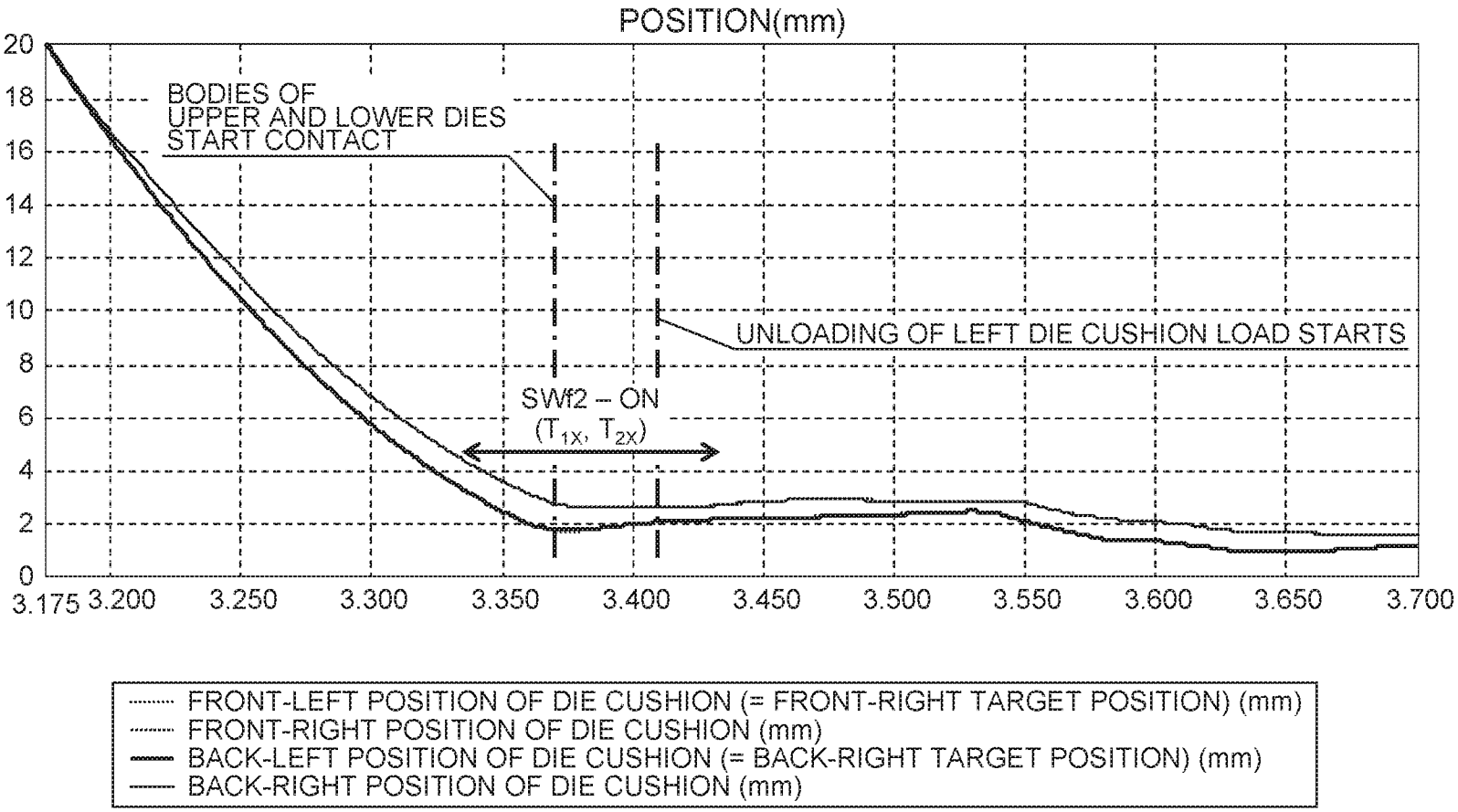
FIG. 14 is an enlarged diagram showing a Y part indicated within a circle in FIG. 9.

FIGS. 13 and 14 are enlarged diagrams showing an X part and a Y part indicated within circles in FIG. 9.

<Cushion Pad Standby Process>

Around 2.3 seconds shown in FIG. 8 and so on, the cushion pad holds the blankholders on the left and right sides via the cushion pins at a die-cushion start slide position (position of the slide when die cushioning is started) of 200 mm. The cushion pad stands-by in a state where a blank is loaded on the left blankholder and no blank is loaded on the right blankholder.

In this case, in the die cushion control device shown in FIG. 7, a switch SWtr in the torque command selector 360 for each of the drive shafts selects a position-controlling torque command signal (torque command signal for positional control) on the input P side so that the die cushion position controller 304 functions.

In the die cushion position controller 304 for each of the drive shafts, the SWpr in the position command selector 310 is switched to the input A side, and a die cushion start position (standby position) command signal output from the die cushion position command unit 302 is selected as a die cushion position command value.

In the feedforward compensator 350, the switch SWf1 is turned off so that the feedforward compensation does not function.

The position-controlling torque command signal, which is generated in the die cushion position controller 304 for each of the drive shafts, is output as torque command signals (LF1 to LF3, LB1 to LB3, RF1 to RF3, RB1 to RB3) through the torque command selector 360, to the three servo motors (SM1 to SM3) that drive the each of the drive shafts. Thus, each of the drive shafts is positionally controlled such that the cushion pad 210 stands by at a predetermined cushion pad standby position.

During the cushion pad standby process (around 2.3 seconds) under the die cushion position control, the left and right position deviation on the front side of the die cushion is substantially equal to zero, as shown in FIG. 10, for example. The torque signals for the representative servo motors that drive the respective drive shafts are tuned as shown in FIG. 12.

<Preliminary Acceleration Process Immediately Before Start of Forming>

As shown in FIG. 13, around 2.55 seconds, the cushion pad accelerates slightly downward to alleviate the impact caused when the upper die 120LU, and the lower die 120LD to blankholder 202L on the left side collide with each other through the blank 10L at the time of starting the forming.

In this case, in the die cushion control device shown in FIG. 7, the switch SWtr in the torque command selector 360 for each of the drive shafts selects the position-controlling torque command signal on the input P side so that the die cushion position controller 304 functions.

In the die cushion position controller 304 for each of the drive shafts, the switch SWpr in the position command selector 310 is switched to the input A side so that a die cushion position command value for preliminary acceleration, which is output from the die cushion position command unit 302, is selected as the die cushion position command value.

In the feedforward compensator 350, the switch SWf1 is turned off so that the feedforward compensation does not function.

Eventually, in the preliminary acceleration process, the position controller 320 and the stabilization controller 330 for each of the servo motors function, and the die cushion positions of the drive shafts are positionally controlled so as to follow the common position command signal for preliminary acceleration and are tuned to each other.

For example, in FIG. 10, position deviation in the left-right direction on the front side of the die cushion is approximately −0.03 mm. Also, referring to FIG. 12, the torque command signals for the representative servo motors that drive each of the drive shafts are tuned to each other (while exhibiting a negative value).

<(Left Side) Forming (Die Cushion Load Control) Process>

A die cushion load acts on the left side of the cushion pad around 2.6 seconds to 3.41 seconds as shown in FIG. 11, and the forming of the left part proceeds. An operating force for keeping balance of the cushion pad acts on the right side of the cushion pad under the die cushion position control so as not to cause tilting of the cushion pad in the left-right direction.

In this case, in the die cushion control device shown in FIG. 7, the switch SWpr in each of the position command selectors 310RF and 310RB for the front-right drive shaft and the back-right drive shaft is switched to the input B side. As a result, the position signals for the front-left drive shaft and the back-left drive shaft which are subject to the die cushion load control and indirectly pressed down by the slide, are respectively used as the position command values (target values for position control).

In the feedforward compensator 350, the switch SWf1 is turned on so that the feedforward compensation functions.

Regarding the feedforward compensator 350, when the upper die 120LU on the left side collides with the cushion pad 210 through the lower die 120LD and blankholder 202L and the cushion pins 204, the switch SWf2 within the feedforward compensator 350 is switched to the input y side for 0.03 seconds from the point in time of 2.59 seconds in the X part (FIG. 13) in FIG. 9 so that the phase lead compensation element 354 having time constants of $T_{1X}$ and $T_{2X}$ (where $T_{1X}<T_{2X}$) is caused to operate.

This relates to an operation in which the front-right and back-right torques of the servo motors largely change to the negative side so that the left side of the cushion pad strongly accelerates downward, referring to FIG. 12.

After that, the switch SWf2 is temporarily switched to the input x side and then is switched to the input y side again near the bottom dead center (Y part (FIG. 14) in FIG. 9), so that the phase lead compensation element 354 having time constants of $T_{1Y}$ and $T_{2Y}$ (where $T_{1Y}<T_{2Y}$) is caused to operate during a period equal to approximately 0.02 seconds from the time immediately before the bodies of the upper and lower start to come into contact with each other to the time immediately after the die cushion load on the left side is unloaded.

Eventually, during the forming process, the position controller 320, the stabilization controller 330 for each of the servo motors, and the feedforward compensator 350 function, and the die cushion positions of the front-right and back-right drive shafts are tuned to each other, while being positionally controlled so as to follow the die cushion position (target value) of the first drive shaft subject to the die cushion load control and reduce the deviation from the die cushion position of the first drive shaft.

In this manner, in the specific die cushion load control process, in a case where a torque command signal for the second drive shaft subject to the die cushion position control is computed, torque command signals for the servo motors corresponding to the second drive shaft are computed based on the target value and the position detection value, and a feedforward compensation amount computed by the feedforward compensator 350 is added to the computed torque command signal so that control over the die cushion position can be performed to be within ±2 mm to the target value.

In this embodiment, the positions are controlled to have a position deviation equal to or lower than about −1.2 mm to 0 mm to the target value as shown in FIG. 10.

The reason why the positional control is performed to be within ±2 mm to the target value is that a deviation exceeding ±2 mm results in excess of the allowable tilt angle of the cushion pad, which is set in the die cushion device of this embodiment, and that the die cushion device abnormally is stopped.

In this embodiment, the drive shafts (second drive shafts) subject to the die cushion position control during the specific die cushion load control process are the front-right and back-right drive shafts. In order to perform the die cushion position control over these drive shafts, the die cushion (cushion pad) position of the adjacent (closer) one of the front-left and back-left drive shafts (first drive shafts) subject to the die cushion load control is used as a target value for the position control. However, without limiting thereto, a mean value of two or more position values detected by the die cushion position detectors corresponding to two or more first drive shafts may be used as a common target value.

<Knock-Out Process>

After approximately 3.41 seconds shown in FIG. 8 and so on, the cushion pad has a formed product thereon. The cushion pad is raised (knock-out operation) to the die-cushion start slide position (standby position) at a predetermined (preset) knock-out speed.

In this case, in the die cushion control device shown in FIG. 7, the switch SWtr in the torque command selector 360 for each of the drive shafts selects the position-controlling torque command signal on the input P side so that the die cushion position controller 304 functions.

In the die cushion position controller 304 for each of the drive shafts, the switch SWpr in the position command selector 310 is switched to the input A side so that a knocking-out position command signal (position command signal for knock-out), which is output from the die cushion position command unit 302, is selected as a die cushion position command value.

In the feedforward compensator 350, the switch SWf1 is turned off so that the feedforward compensation does not function.

Eventually, during the knock-out process, the position controller 320 and the stabilization controller 330 for each of the servo motors function, and the die cushion positions of the drive shafts are positionally controlled so as to follow the common knocking-out position command signal, and are tuned to each other.

Note that, though an example of the controller that allows free die arrangement only in the left-right direction is described in this embodiment, a controller that allows free die arrangement also in the front-back direction can be achieved based on the similar idea as that of this embodiment.

<Method for Controlling Die Cushion Device>

Figure 15:
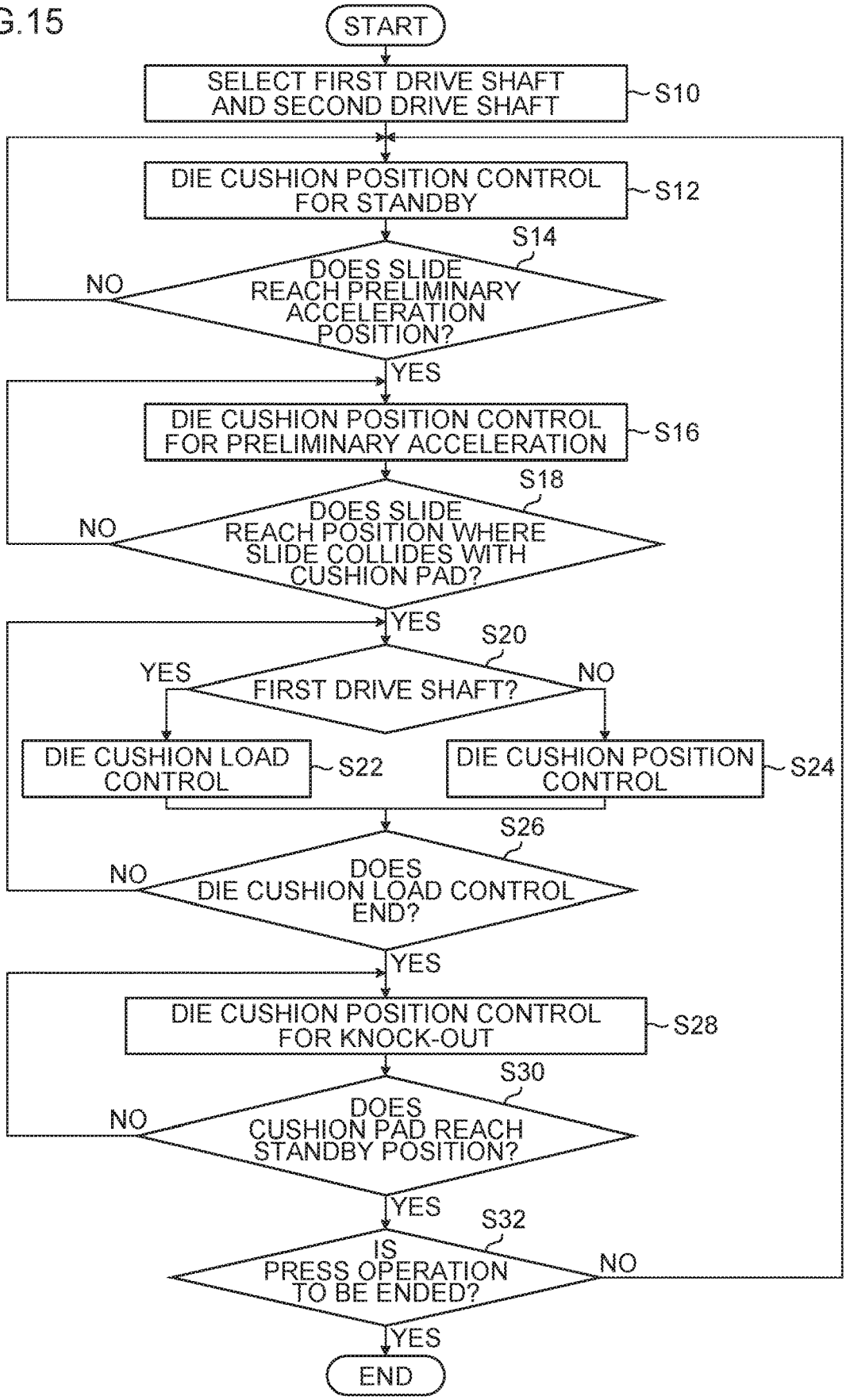
FIG. 15 is a flowchart showing an embodiment of a method for controlling a die cushion device according to the present invention.
Figure 16:
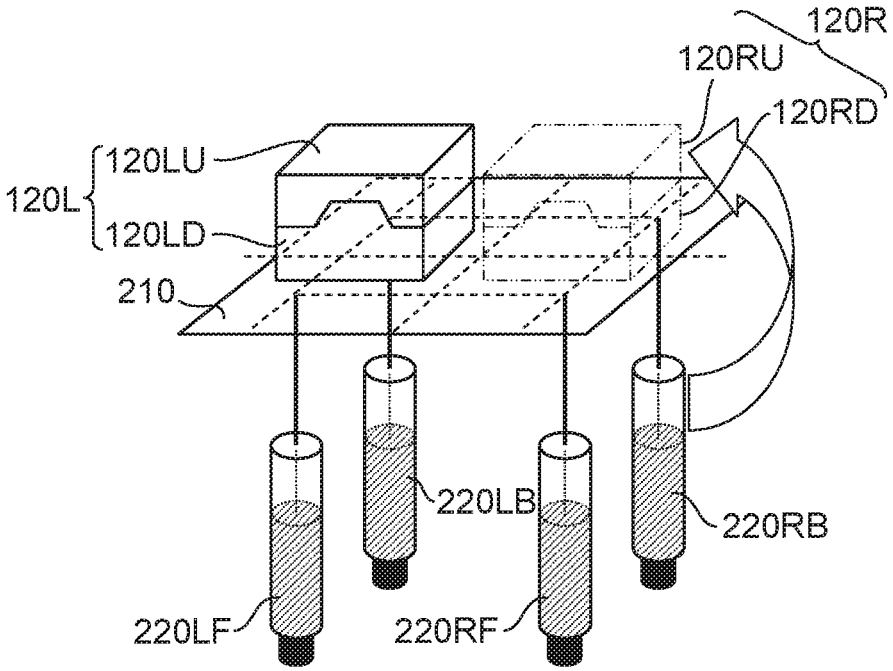
FIG. 16 is a diagram used for explaining a problem of a conventional die cushion device.

FIG. 15 is a flowchart showing an embodiment of a method for controlling the die cushion device according to the present invention.

FIG. 15 shows a method for controlling the die cushion device 200 particularly shown in FIGS. 1 and 2 in a case where only a left part is produced with the left die 120L (in the case of the condition Z).

Referring to FIG. 15, each of the four front-left, back-left, front-right and back-right drive shafts corresponding to the four hydraulic cylinders (220LF, 220LB, 220RF and 220RB) that drive the cushion pad 210 (step S10) is individually selected as either one of the first drive shaft subject to the die cushion load control by the die cushion load controller 308 and the second drive shaft subject to the die cushion position control by the die cushion position controller 304.

This selection is enabled by pressing a button to which "PRODUCE LEFT SIDE ONLY" is allocated on a die cushion operation screen, for example. In accordance with the selection result, selection of a torque command signal in the torque command selector 360 for each of the drive shafts, selection of a position command value in the position command selector 310 (FIG. 7) and so on are performed. In this embodiment, two drive shafts corresponding to the left hydraulic cylinders (220LF and 220LB) are selected as the first drive shafts, and two drive shafts corresponding to the right hydraulic cylinders (220RF and 220RB) are selected as the second drive shafts.

Subsequently, the die cushion position controller 304 for each of the drive shafts performs position control over the corresponding drive shaft such that the cushion pad 210 can stand by at a predetermined cushion pad standby position (step S12).

While the cushion pad is standing by, the die cushion control device determines whether the slide 110 reaches a preliminary acceleration position or not based on the slide position signal indicating the position of the slide 110 (step S14). When the position of the slide 110 reaches the preliminary acceleration position, the die cushion position controller 304 for each of the drive shafts controls the corresponding position of the cushion pad 210 (preliminarily accelerates the cushion pad 210) based on a die cushion position command value for preliminary acceleration (step S16).

During the preliminary acceleration, the die cushion control device determines whether the slide 110 reaches a position where the slide 110 collides with the cushion pad 210 through the die 120L, the blank and so on based on the slide position signal indicating the position of the slide 110 (step S18). When the position of the slide 110 reaches the position where the slide 110 collides with the cushion pad 210, the four die cushion controllers corresponding to the respective drive shafts use different control methods during the die cushion load control process in accordance with whether the corresponding drive shaft to be controlled is the first drive shaft or the second drive shaft (step S20).

In this embodiment, the front-left and back-left die cushion controllers control the drive shafts selected as the first drive shafts with the die cushion load controller 308 (step S22), and the front-right and back-right die cushion controllers control the drive shafts selected as the second drive shafts with the die cushion position controller 304.

The die cushion position control with the die cushion position controller 304 in this case uses, as a target value, a position detection value detected by the die cushion position detector corresponding to the first drive shaft adjacent to the second drive shaft. In this embodiment, the die cushion position controller 304 corresponding to the front-right drive shaft uses, as a target value, a position detection value detected by the die cushion position detector corresponding to the front-left drive shaft subject to the die cushion load control. Further, the die cushion position controller 304 corresponding to the back-right drive shaft uses, as a target value, a position detection value detected by the die cushion position detector corresponding to the back-left drive shaft subject to the die cushion load control.

Subsequently, the die cushion control device determines whether the die cushion load control ends or not (whether the slide 110 reaches a predetermined region in the vicinity of the bottom dead center) (step S26). If the die cushion load control ends, the die cushion position controller 304 for each of the drive shafts controls the corresponding position of the cushion pad 210 based on the die cushion position command value for knock-out (step S28).

When the cushion pad 210 reaches the standby position, the due cushion control device determines whether the press operation is to be ended or not (step S32). In a case where it is determined that the press operation is not to be ended, the processing moves to step S12, and the processing from step S12 to step S32 is repeated. In a case where it is determined that the press operation is to be ended, production of the left part in the case of the condition Z ends.

[Others]

In this embodiment, by pressing the "PRODUCE LEFT SIDE ONLY" button on the die cushion operation screen, each drive shaft of the four front-left, back-left, front-right and back-right drive shafts is manually determined as either one of the first drive shaft subject to the die cushion load control and the second drive shaft not subject to the die cushion load control (the second drive shaft subject to the die cushion position control) during the specific die cushion load control process, and, in accordance with the selection result, the selections in the torque command selector 360 and the position command selector 310 are performed. However, the present invention is not limited to the example. The selection (recognition) of the first drive shaft or the second drive shaft may be automatically performed by performing a comparison operation on pressures in the hydraulic cylinders corresponding to the drive shafts during the cushion pad standby (position control) and determining which drive shaft bears the mass of the die(s) and blankholder(s) or by attaching area sensors (that detect whether a die is attached) to areas on the bolster, performing a comparison operation on signals from the area sensors and recognizing the area(s) in which a die is attached.

In this embodiment, the operating fluid for the hydraulic cylinders and hydraulic pumps/motors that raise and lower the cushion pad, may be water or other fluid, as well as oil.

Furthermore, the cushion pad raising and lowering devices which raise and lower the cushion pad have been described as including hydraulic cylinders, hydraulic pumps/motors and servo motors. However, the configuration is not limited to this example. So long as the die cushion load control and the die cushion position control can be performed, the present invention is applicable to any types of servo die cushion device. For example, the present invention is applicable to a device including a screw nut mechanism that raises and lowers the cushion pad and a servo motor that drives the screw nut mechanism, or a device including a rack-and-pinion mechanism that raises and lowers the cushion pad and a servo motor that drives the rack-and-pinion mechanism.

The number of drive shafts for one cushion pad in the die cushion device may be two or more, without limiting to the four in this embodiment. Further, the cushion pad may be divided into a plurality of regions (two divisions in the left-right direction shown in FIG. 6).

Still further, it is apparent that the present invention is not limited to the embodiments described above but various changes can be made without departing from the spirit and scope of the present invention.

REFERENCE SIGNS LIST

10L, 10R blank
100 press machine
102 bed
103 bolster
104 column
105 connecting rod
108 guide unit
110 slide
112 crank axis
118 encoder
120 die
120' die
120L die
120LD lower die
120LU upper die
120R die
120RD lower die
120RU upper die
200 die cushion device
200 mm die-cushion start slide position

202L, 202R blankholder
204 cushion pin
210, 210L, 210R cushion pad
220LF, 220LB, 220RF, 220RB hydraulic cylinder
220LFa, 220LBa, 220RFa, 220RBa piston rod
224 die cushion position detector
232 pipe
234 pipe
252 accumulator
253 relief valve
258 angular speed detector
262 non-return valve
264 pressure detector
300LB back-left die cushion controller
300LF front-left die cushion controller
300RB back-right die cushion controller
300RF front-right die cushion controller
302 die cushion position command unit
304 die cushion position controller
306 die cushion load command unit
308 die cushion load controller
310 position command selector
320 position controller
322, 331A to 333A subtractor
324 position control compensator
330 stabilization controller
331B to 333B stabilization control compensator
341, 342, 343 adder
350 feedforward compensator
352 differential element
354 phase lead compensation element
356 adjuster
360 torque command selector
P/M1 to P/M3 hydraulic pump/motor
SM1 to SM3 servo motor
SWf1, SWf2, SWpr, SWtr switch

What is claimed is:

1. A die cushion device comprising:

a plurality of cushion pad raising and lowering devices which include a plurality of drive shafts configured to support a cushion pad, and are configured to drive the respective drive shafts to raise and lower the cushion pad;

a die cushion load controller configured to control each of the drive shafts of the plurality of cushion pad raising and lowering devices to generate die cushion load on the cushion pad;

a die cushion position controller configured to control each of the drive shafts of the plurality of cushion pad raising and lowering devices to control a position of the cushion pad; and a selector configured to independently select each of the drive shafts of the plurality of cushion pad raising and lowering devices, as either one of a first drive shaft of the plurality of drive shafts subject to die cushion load control by the die cushion load controller and a second drive shaft of the plurality of drive shafts not subject to the die cushion load control by the die cushion load controller, wherein, when a specific die cushion load control in which the selected drive shafts includes the first drive shaft and the second drive shaft is performed, the die cushion load controller controls only the first drive shaft selected by the selector, wherein the selector independently selects each of the drive shafts of the plurality of cushion pad raising and lowering devices, as either another first drive shaft of the plurality of drive shafts subject to die cushion load control by the die cushion load controller and another second drive shaft of the plurality of drive shafts subject to die cushion position control by the die cushion position controller, and wherein, when the specific die cushion load control is performed, the die cushion load controller controls the first drive shaft selected by the selector, and the die cushion position controller controls the second drive shaft selected by the selector.

2. The die cushion device according to claim 1, further comprising a plurality of die cushion position detectors configured to detect positions of the cushion pad corresponding to positions of the drive shafts of the plurality of cushion pad raising and lowering devices in a raising-lowering direction, and output respective position detection values indicating the detected positions, wherein, when the specific die cushion load control is performed, the die cushion position controller controls the second drive shaft based on a position detection value detected by a die cushion position detector corresponding to the first drive shaft.

3. The die cushion device according to claim 2, wherein the die cushion position controller uses, as a target value, the position detection value detected by the die cushion position detector corresponding to the first drive shaft adjacent to the second drive shaft, or uses, as a target value, a mean value of two or more position detection values detected by a plurality of die cushion position detectors corresponding to a plurality of first drive shafts.

4. The die cushion device according to claim 3, wherein, when the specific die cushion load control is performed, the die cushion position controller controls the second drive shaft so as to fall within ±2 mm to the target value.

5. The die cushion device according to claim 4, wherein the plurality of cushion pad raising and lowering devices include a plurality of servo motors configured to drive the respective drive shafts, and the die cushion position controller further configured to:

compute a torque command signal for a servo motor of the plurality of servo motors corresponding to the second drive shaft based on the target value and the position detection value detected by the die cushion position detector corresponding to the second drive shaft; and add a signal in proportion to a signal acquired by differentiating the target value by time or a signal in proportion to a speed of a slide of a press machine, to the computed torque command signal so as to fall within ±2 mm to the target value.

6. The die cushion device according to claim 4, wherein the plurality of cushion pad raising and lowering devices include a plurality of servo motors configured to drive the respective drive shafts, and the die cushion position controller further configured to:

compute a torque command signal for a servo motor of the plurality of servo motors corresponding to the second drive shaft based on the target value and the position detection value detected by the die cushion position detector corresponding to the second drive shaft; and adds a signal in proportion to a signal acquired by differentiating the target value by time or a signal acquired by multiplying a signal in proportion to a speed of a slide of a press machine by a phase lead compensation element, to the computed torque command signal so as to fall within ±2 mm to the target value.

7. The die cushion device according to claim 5, further comprising a plurality of angular speed detectors configured to respectively detect rotational angular speeds of the plurality of servo motors, wherein the die cushion position controller includes a stabilization controller configured to use angular speed signals detected by the plurality of angular speed detectors as angular speed feedback signals.

8. The die cushion device according to claim 5, wherein the plurality of cushion pad raising and lowering devices include:

a plurality of hydraulic cylinders including piston rods functioning as the drive shafts; and a plurality of hydraulic pumps/motors configured to causing operating fluid to act on die-cushion load generation side pressurizing chambers of the plurality of hydraulic cylinders, and the plurality of servo motors are axially connected to the plurality of hydraulic pumps/motors.

9. A method for controlling a die cushion device comprising a plurality of cushion pad raising and lowering devices which include a plurality of drive shafts configured to support a cushion pad, and are configured to drive the respective drive shafts to raise and lower the cushion pad, a die cushion load controller configured to control each of the drive shafts of the plurality of cushion pad raising and lowering devices to generate a die cushion load on the cushion pad, and a die cushion position controller configured to control each of the drive shafts of the plurality of cushion pad raising and lowering devices to control the position of the cushion pad, the method comprising:

during a specific die cushion load control process in which the selected drive shafts include a first drive shaft of the plurality of drive shafts and a second drive shaft of the plurality of drive shafts, independently selecting, by a selector, each of the drive shafts of the plurality of cushion pad raising and lowering devices, as either one of the first drive shaft of the plurality of drive shafts subject to die cushion load control by the die cushion load controller and the second drive shaft of the plurality of drive shafts not subject to the die cushion load control by the die cushion load controller; and during the specific die cushion load control process, controlling only the first drive shaft by the die cushion load controller, wherein the selecting by the selector includes independently selecting each of the drive shafts of the plurality of cushion pad raising and lowering devices, as either another first drive shaft of the plurality of drive shafts subject to die cushion load control by the die cushion load controller and another second drive shaft of the plurality of drive shafts subject to die cushion position control by the die cushion position controller, and during the specific die cushion load control process, the first drive shaft is controlled by the die cushion load controller and the second drive shaft is controlled by the die cushion position controller.

10. The method for controlling the die cushion device according to claim 9, wherein the die cushion device further includes a plurality of die cushion position detectors configured to detect positions of the cushion pad corresponding to positions of the drive shafts of the plurality of cushion pad raising and lowering devices in a raising-lowering direction, and output respective position detection values indicating the detected positions, and during the specific die cushion load control process, the second drive shaft is controlled by the die cushion position controller, based on a position detection value detected by the die cushion position detector corresponding to the first drive shaft.

11. The method for controlling the die cushion device according to claim 10, wherein the die cushion position controller uses, as a target value, a position detection value detected by the die cushion position detector corresponding to the first drive shaft adjacent to the second drive shaft, or uses, as a target value, a mean value of two or more position detection values detected by a plurality of die cushion position controllers corresponding to a plurality of first drive shafts.

12. The method for controlling the die cushion device according to claim 11, wherein, during the specific die cushion load control process, the second drive shaft is controlled so as to fall within ±2 mm to the target value by the die cushion position controller.

13. A method for controlling a die cushion device comprising a plurality of cushion pad raising and lowering devices which include a plurality of drive shafts configured to support a cushion pad, and are configured to drive the respective drive shafts to raise and lower the cushion pad, a die cushion load controller configured to control each of the drive shafts of the plurality of cushion pad raising and lowering devices to generate a die cushion load on the cushion pad, and a die cushion position controller configured to control each of the drive shafts of the plurality of cushion pad raising and lowering devices to control the position of the cushion pad, the method comprising:

during a specific die cushion load control process, independently selecting, by a selector, each of the drive shafts of the plurality of cushion pad raising and lowering devices, as either one of a first drive shaft of the plurality of drive shafts subject to die cushion load control by the die cushion load controller and a second drive shaft of the plurality of drive shafts not subject to the die cushion load control by the die cushion load controller; and during the specific die cushion load control process, controlling only the first drive shaft by the die cushion load controller, wherein the specific die cushion load control process includes:

a die cushion load control process to be performed in a case where a die is arranged at a deviated position with respect to a center of the cushion pad; or a die cushion load control process to be performed in a case where a blank does not exist on part of the plurality of drive shafts.

* * * * *